US011633016B2

(12) United States Patent
Orand et al.

(10) Patent No.: US 11,633,016 B2
(45) **Date of Patent: *Apr. 25, 2023**

(54) FOOTWEAR ARTICLE WITH TONGUE REINFORCER

(71) Applicant: NIKE, Inc., Beaverton, OR (US)

(72) Inventors: Austin J. Orand, Portland, OR (US); Aaron B. Weast, Portland, OR (US); Peter P. Williams, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/482,809

(22) Filed: Sep. 23, 2021

(65) Prior Publication Data

US 2022/0000220 A1 Jan. 6, 2022

Related U.S. Application Data

(63) Continuation of application No. 16/662,628, filed on Oct. 24, 2019, now Pat. No. 11,219,274, which is a continuation of application No. 16/230,898, filed on Dec. 21, 2018, now Pat. No. 10,455,898.

(51) Int. Cl.

| | |
|---|---|
| ***A43B 23/26*** | (2006.01) |
| ***A43B 11/00*** | (2006.01) |
| ***A43C 11/08*** | (2006.01) |
| ***A43B 23/08*** | (2006.01) |

(52) U.S. Cl.

CPC ..... *A43B 23/26* (2013.01); *A43B 11/00* (2013.01); *A43B 23/088* (2013.01); *A43C 11/08* (2013.01)

(58) Field of Classification Search

CPC ..... A43B 23/08; A43B 23/088; A43B 23/26; A43B 11/00

USPC ..... 36/54, 69, 138

See application file for complete search history.

(56) References Cited

U.S. PATENT DOCUMENTS

| | | | |
|---|---|---|---|
| 91,547 | A | 6/1869 | Leathe |
| 112,439 | A | 3/1871 | Francis |
| 219,436 | A | 9/1879 | Beneke |
| 487,860 | A | 12/1892 | Vail |

(Continued)

FOREIGN PATENT DOCUMENTS

| | | | |
|---|---|---|---|
| CN | 2138904 | Y | 7/1993 |
| CN | 2438353 | Y | 7/2001 |

(Continued)

OTHER PUBLICATIONS

Office Action received for European Patent Application No. 19836920.9, dated Mar. 28, 2022, 7 pages.

(Continued)

*Primary Examiner* — Marie D Bays

(74) *Attorney, Agent, or Firm* — Shook Hardy & Bacon, LLP

(57) ABSTRACT

A footwear article includes a tongue and a tongue reinforcer, which helps the tongue maintain a shape and position when the tongue is subjected to forces or adjustments, such as from other footwear-article elements or from a wearer. For example, the tongue reinforcer may help the tongue maintain a shape and position when a wearer is inserting his or her foot into the footwear article or when medial and/or lateral quarters press inward on the tongue.

17 Claims, 13 Drawing Sheets

(56) References Cited

U.S. PATENT DOCUMENTS

| | | | |
|---|---|---|---|
| 827,330 | A | 7/1906 | Tillson |
| 863,549 | A | 8/1907 | Metz |
| 882,109 | A | 3/1908 | Harris |
| 905,323 | A | 12/1908 | King et al. |
| 911,025 | A | 2/1909 | Blaisdell |
| 1,028,598 | A | 6/1912 | Papp |
| 1,081,678 | A | 12/1913 | Langerak |
| 1,155,354 | A | 10/1915 | Hallock |
| 1,464,342 | A | 8/1923 | Rothacher |
| 1,494,236 | A | 5/1924 | Greathouse |
| 1,686,175 | A | 10/1928 | Read |
| D98,150 | S | 1/1936 | Drake |
| 2,069,752 | A | 2/1937 | Dorr |
| 2,097,810 | A | 11/1937 | Dawes |
| 2,450,250 | A | 9/1948 | Napton |
| 2,452,502 | A | 10/1948 | Tarbox |
| 2,736,110 | A | 2/1956 | Hardimon |
| 2,920,402 | A | 1/1960 | Minera |
| 3,146,535 | A | 9/1964 | Owings |
| 3,192,651 | A | 7/1965 | Smith |
| 1,275,895 | A | 8/1981 | Fox |
| 4,489,509 | A | 12/1984 | Libit |
| 4,608,769 | A | 9/1986 | Sturlaugson |
| 4,876,806 | A | 10/1989 | Robinson et al. |
| 4,972,613 | A | 11/1990 | Loveder |
| 5,054,216 | A | 10/1991 | Lin |
| 5,090,140 | A | 2/1992 | Sessa |
| 5,152,082 | A | 10/1992 | Culpepper |
| 5,181,331 | A | 1/1993 | Berger |
| 5,184,410 | A | 2/1993 | Hamilton |
| 5,279,051 | A | 1/1994 | Whatley |
| 5,282,327 | A | 2/1994 | Ogle |
| 5,317,819 | A | 6/1994 | Ellis |
| 5,341,583 | A | 8/1994 | Hallenbeck |
| 5,371,957 | A | 12/1994 | Gaudio |
| 5,406,721 | A | 4/1995 | Marcolin |
| 5,467,537 | A | 11/1995 | Aveni et al. |
| 5,481,814 | A | 1/1996 | Spencer |
| 5,826,353 | A | 10/1998 | Woznicki |
| 5,842,292 | A | 12/1998 | Siesel |
| 5,933,986 | A | 8/1999 | Donnadieu |
| 6,000,148 | A | 12/1999 | Cretinon |
| 6,189,239 | B1 | 2/2001 | Gasparovic et al. |
| 6,314,662 | B1 | 11/2001 | Ellis |
| 6,360,454 | B1 | 3/2002 | Dachgruber et al. |
| 6,378,230 | B1 | 4/2002 | Rotem et al. |
| 6,497,058 | B2 | 12/2002 | Dietrich et al. |
| 6,557,271 | B1 | 5/2003 | Weaver, III |
| 6,684,533 | B1 | 2/2004 | Su |
| 6,874,255 | B2 | 4/2005 | Bernstein |
| 6,880,272 | B2 | 4/2005 | Wells |
| 6,925,732 | B1 | 8/2005 | Clarke |
| 6,938,361 | B2 | 9/2005 | Su |
| 7,082,702 | B2 | 8/2006 | Cretinon |
| 7,103,994 | B2 | 9/2006 | Johnson |
| 7,225,563 | B2 | 6/2007 | Chen et al. |
| 7,392,603 | B1 | 7/2008 | Shepherd et al. |
| 7,439,837 | B2 | 10/2008 | Mcdonald |
| 7,685,747 | B1 | 3/2010 | Gasparovic et al. |
| 7,793,438 | B1 | 9/2010 | Busse et al. |
| 7,823,299 | B1 | 11/2010 | Brigham |
| 7,975,403 | B2 | 7/2011 | Mosher |
| 8,020,317 | B1 | 9/2011 | Sokolowski |
| D648,512 | S | 11/2011 | Schlageter et al. |
| 8,056,264 | B2 | 11/2011 | Sato et al. |
| 8,065,819 | B2 | 11/2011 | Kaufman |
| 8,161,669 | B2 | 4/2012 | Keating |
| 8,245,421 | B2 | 8/2012 | Baudouin et al. |
| 8,769,845 | B2 | 7/2014 | Lin |
| 9,192,204 | B1 | 11/2015 | Liles et al. |
| 9,820,527 | B2 | 11/2017 | Pratt et al. |
| D840,663 | S | 2/2019 | Flanagan et al. |
| D845,303 | S | 7/2019 | Flanagan et al. |
| 10,455,898 | B1 * | 10/2019 | Orand ..... A43C 11/004 |
| 10,617,174 | B1 | 4/2020 | Hopkins et al. |
| 10,638,810 | B1 | 5/2020 | Cheney et al. |
| 10,905,192 | B1 | 2/2021 | Cheney |
| 11,191,321 | B2 | 12/2021 | Kilgore et al. |
| 11,219,274 | B2 * | 1/2022 | Orand ..... A43B 1/0081 |
| 11,344,077 | B2 | 5/2022 | Hopkins et al. |
| 2002/0053147 | A1 | 5/2002 | Borsoi et al. |
| 2002/0066213 | A1 | 6/2002 | Wells |
| 2002/0092205 | A1 | 7/2002 | Hall et al. |
| 2002/0112376 | A1 | 8/2002 | Tomat |
| 2002/0144434 | A1 | 10/2002 | Farys et al. |
| 2004/0111921 | A1 | 6/2004 | Lenormand |
| 2004/0244226 | A1 | 12/2004 | Farys et al. |
| 2005/0039348 | A1 | 2/2005 | Raluy et al. |
| 2005/0081404 | A1 | 4/2005 | Hurd et al. |
| 2005/0198869 | A1 | 9/2005 | Bouche et al. |
| 2006/0010718 | A1 | 1/2006 | Auger et al. |
| 2006/0032091 | A1 | 2/2006 | Kilgore |
| 2007/0074425 | A1 | 4/2007 | Leong |
| 2007/0256332 | A1 | 11/2007 | Calderone |
| 2008/0083138 | A1 | 4/2008 | Lacorazza et al. |
| 2008/0086911 | A1 | 4/2008 | Labbe |
| 2008/0120871 | A1 | 5/2008 | Sato et al. |
| 2008/0155788 | A1 | 7/2008 | Wilcox |
| 2008/0307673 | A1 | 12/2008 | Johnson |
| 2009/0100712 | A1 | 4/2009 | Baker et al. |
| 2011/0016751 | A1 | 1/2011 | Somerville |
| 2011/0308109 | A1 | 2/2011 | Sokolowski |
| 2011/0119959 | A1 | 5/2011 | Bodner |
| 2011/0146106 | A1 | 6/2011 | Kaufman |
| 2011/0185592 | A1 | 8/2011 | Nishiwaki et al. |
| 2012/0079742 | A1 | 4/2012 | Ferreira et al. |
| 2012/0180338 | A1 | 7/2012 | Lin |
| 2012/0192453 | A1 | 8/2012 | Raysse et al. |
| 2012/0198721 | A1 | 8/2012 | Cavaliere |
| 2012/0297643 | A1 | 11/2012 | Shaffer et al. |
| 2012/0304491 | A1 | 12/2012 | Kimura et al. |
| 2012/0317839 | A1 | 12/2012 | Pratt |
| 2013/0185959 | A1 | 7/2013 | Coleman |
| 2013/0219747 | A1 | 8/2013 | Lederer |
| 2013/0247416 | A1 | 9/2013 | Nurse et al. |
| 2014/0130376 | A1 | 5/2014 | Fahmi et al. |
| 2014/0137434 | A1 | 5/2014 | Craig |
| 2014/0150292 | A1 | 6/2014 | Podhajny et al. |
| 2014/0173935 | A1 | 6/2014 | Sabbioni |
| 2014/0202044 | A1 | 7/2014 | Adami et al. |
| 2014/0305005 | A1 | 10/2014 | Yeh |
| 2015/0237960 | A1 | 8/2015 | Mallen et al. |
| 2015/0305432 | A1 | 10/2015 | Wiens |
| 2016/0007687 | A1 | 1/2016 | Surace et al. |
| 2016/0029743 | A1 | 2/2016 | Cavaliere et al. |
| 2016/0088899 | A1 | 3/2016 | Liles et al. |
| 2016/0302530 | A1 | 10/2016 | Smith et al. |
| 2016/0324269 | A1 | 11/2016 | Dombrow et al. |
| 2016/0332063 | A1 | 11/2016 | Van Horne |
| 2016/0374427 | A1 | 12/2016 | Zahabian |
| 2017/0055630 | A1 | 3/2017 | Marshall |
| 2017/0099908 | A1 | 4/2017 | Lee et al. |
| 2017/0105485 | A1 | 4/2017 | Schenone et al. |
| 2017/0231319 | A1 | 8/2017 | Bohnsack et al. |
| 2017/0303632 | A1 | 10/2017 | Pratt et al. |
| 2017/0360143 | A1 | 12/2017 | Pratt et al. |
| 2017/0360151 | A1 | 12/2017 | Pratt |
| 2017/0370027 | A1 | 12/2017 | Da Costa Pereira Machado et al. |
| 2018/0098601 | A1 | 4/2018 | Hartenstein et al. |
| 2018/0110287 | A1 | 4/2018 | Hopkins et al. |
| 2018/0110292 | A1 | 4/2018 | Beers et al. |
| 2018/0206588 | A1 | 7/2018 | Pratt et al. |
| 2018/0213882 | A1 | 8/2018 | Morse |
| 2018/0279721 | A1 | 10/2018 | Doenges |
| 2018/0289109 | A1 | 10/2018 | Beers et al. |
| 2018/0338583 | A1 | 11/2018 | Sullivan |
| 2019/0045884 | A1 | 2/2019 | Uda et al. |
| 2019/0297999 | A1 | 10/2019 | Nakaya et al. |
| 2020/0000178 | A1 | 1/2020 | Pratt et al. |
| 2020/0196703 | A1 | 6/2020 | Hopkins |
| 2020/0196709 | A1 | 6/2020 | Orand et al. |
| 2020/0205511 | A1 | 7/2020 | Hopkins et al. |
| 2020/0205518 | A1 | 7/2020 | Hopkins et al. |
| 2020/0205520 | A1 | 7/2020 | Kilgore |

(56) References Cited

U.S. PATENT DOCUMENTS

| | | | |
|---|---|---|---|
| 2020/0229536 | A1 | 7/2020 | Hopkins et al. |
| 2020/0253333 | A1 | 8/2020 | Kilgore et al. |
| 2020/0297076 | A1 | 9/2020 | Kilgore et al. |
| 2020/0390183 | A1 | 12/2020 | Arnold |
| 2021/0068494 | A1 | 3/2021 | Zahabian |
| 2021/0106094 | A1 | 4/2021 | Cheney |
| 2021/0112914 | A1 | 4/2021 | Cheney |
| 2021/0112915 | A1 | 4/2021 | Hopkins et al. |
| 2021/0112916 | A1 | 4/2021 | Schulten |
| 2021/0204643 | A1 | 7/2021 | Kyle |
| 2021/0204644 | A1 | 7/2021 | Kyle |
| 2021/0378356 | A1 | 12/2021 | Cheney et al. |

FOREIGN PATENT DOCUMENTS

| | | | |
|---|---|---|---|
| CN | 1403041 | A | 3/2003 |
| CN | 1832693 | A | 9/2006 |
| CN | 1993064 | A | 7/2007 |
| CN | 101022744 | A | 8/2007 |
| CN | 201005111 | Y | 1/2008 |
| CN | 101480282 | A | 7/2009 |
| CN | 101991227 | A | 3/2011 |
| CN | 101991227 | B | 8/2012 |
| CN | 102762121 | A | 10/2012 |
| CN | 103313622 | A | 9/2013 |
| CN | 104203024 | A | 12/2014 |
| CN | 204317632 | U | 5/2015 |
| CN | 105163616 | A | 12/2015 |
| CN | 105611851 | A | 5/2016 |
| CN | 205568021 | U | 9/2016 |
| CN | 108697196 | A | 10/2018 |
| DE | 3928625 | A1 | 3/1991 |
| DE | 19534249 | A1 | 3/1997 |
| DE | 19611797 | A1 | 10/1997 |
| DE | 29809404 | | 8/1998 |
| DE | 10247163 | A1 | 4/2004 |
| DE | 102004005288 | A1 | 8/2005 |
| EP | 0149362 | A2 | 7/1985 |
| EP | 1059044 | A1 | 12/2000 |
| EP | 2319344 | A1 | 5/2011 |
| EP | 2438826 | A1 | 4/2012 |
| FR | 1083503 | A | 1/1955 |
| FR | 1474203 | A | 3/1967 |
| GB | 503525 | A | 4/1939 |
| GB | 2517148 | A | 2/2015 |
| GB | 2517399 | A | 2/2015 |
| JP | 50-11740 | U | 2/1975 |
| JP | 56-158803 | U | 11/1981 |
| JP | 57-72603 | A | 5/1982 |
| JP | 1-80010 | U | 5/1989 |
| JP | 1181910 | A | 7/1989 |
| JP | 2000-139502 | A | 5/2000 |
| JP | 2000-184902 | A | 7/2000 |
| JP | 2001149394 | A | 6/2001 |
| JP | 2005-046520 | A | 2/2005 |
| JP | 2005532115 | A | 10/2005 |
| JP | 2006055571 | A | 3/2006 |
| JP | 2012061046 | A | 3/2012 |
| JP | 2012-110687 | A | 6/2012 |
| KR | 20090130804 | A | 12/2009 |
| NL | 2000762 | C1 | 1/2009 |
| TW | 200743450 | A | 12/2007 |
| WO | 90/00358 | A1 | 1/1990 |
| WO | 2007080205 | A1 | 7/2007 |
| WO | 2009154350 | A1 | 12/2009 |
| WO | 2010059716 | A2 | 5/2010 |
| WO | 2015183486 | A1 | 12/2015 |
| WO | 2016002412 | A1 | 1/2016 |
| WO | 2017/090195 | A1 | 6/2017 |

OTHER PUBLICATIONS

Office Action received for European Patent Application No. 19839789.5, dated Mar. 30, 2022, 7 pages.
Office Action received for European Patent Application No. 19842673.6, dated Mar. 15, 2022, 5 pages.
Non-Final Office Action received for U.S. Appl. No. 16/839,744, dated Jul. 12, 2022, 16 pages.
Office Action received for European Patent Application No. 19842673.6, dated Jul. 22, 2022, 7 pages.
Non-Final Office Action received for U.S. Appl. No. 17/135,220, dated Aug. 2, 2022, 21 pages.
Final Office Action received for U.S. Appl. No. 16/725,754, dated Aug. 16, 2022, 24 pages.
Non-Final Office Action received for U.S. Appl. No. 16/725,860, dated Oct. 22, 2021, 5 pages.
Office action received for European Patent Application No. 19839789.5, dated Sep. 6, 2022, 8 pages.
Partial European Search Report received for European Application No. 22191953.3, dated Sep. 29, 2022, 11 pages.
Final Office Action received for U.S. Appl. No. 16/839,744, dated Jan. 25, 2022, 16 pages.
Non-Final Office Action received for U.S. Appl. No. 16/725,754, dated Feb. 4, 2022, 15 pages.
Non-Final Office Action received for U.S. Appl. No. 16/894,266, dated Jan. 5, 2022, 10 pages.
Notice of Allowance received for U.S. Appl. No. 16/725,860, dated Feb. 8, 2022, 7 pages.
Intention to Grant received for European Patent Application No. 19842490.5, dated Apr. 12, 2022, 6 pages.
Notice of Allowance received for U.S. Appl. No. 16/894,266, dated May 23, 2022, 8 pages.
Final Office Action received for U.S. Appl. No. 16/839,744, dated Dec. 9, 2022, 18 pages.
Intention to Grant received for European Patent Application No. 19836920.9, dated Oct. 28, 2022, 6 pages.
Final Office Action received for U.S. Appl. No. 17/135,220, dated Jan. 25, 2023, 22 pages.
Extended European Search Report received for European Application No. 22191953.3, dated Jan. 9, 2023, 10 pages.
Non-Final Office Action received for U.S. Appl. No. 17/950,814, dated Dec. 27, 2022, 10 pages.
Non-Final Office Action received for U.S. Appl. No. 17/950,798, dated Dec. 16, 2022, 8 pages.
Non-Final Office Action received for U.S. Appl. No. 17/950,781, dated Dec. 14, 2022, 9 Pages.
Office Action received for European Patent Application No. 19842673.6, dated Feb. 7, 2023, 6 pages.

* cited by examiner

FOOTWEAR ARTICLE WITH TONGUE REINFORCER

CROSS-REFERENCE TO RELATED APPLICATIONS

This Continuation claims priority to U.S. Non-Provisional patent application Ser. No. 16/662,628 (filed Oct. 24, 2019), which is a continuation of U.S. Non-Provisional patent application Ser. No. 16/230,898 (filed Dec. 21, 2018), both of which are incorporated hereby by reference in their entireties.

TECHNICAL FIELD

This disclosure relates to a footwear article having a tongue reinforcer.

BACKGROUND

Some footwear articles include an ankle collar that is manipulated when the footwear article is put on. For example, the ankle collar may be depressed towards the sole as the wearer's foot is slid into the upper. Furthermore, some of these footwear articles include a collar elevator operable to move the ankle collar from the depressed or lowered state to the raised state. An example of one type of collar elevator is described in U.S. Pat. No. 9,820,527, and examples of other collar elevators are described in US Pat. Pub. 2018/0110292 and US Pat. Pub. 2018/0289109.

BRIEF DESCRIPTION OF THE DRAWINGS

Some subject matter described in this disclosure makes reference to drawing figures, which are incorporated herein by reference in their entirety.

DETAILED DESCRIPTION

Figure 1:
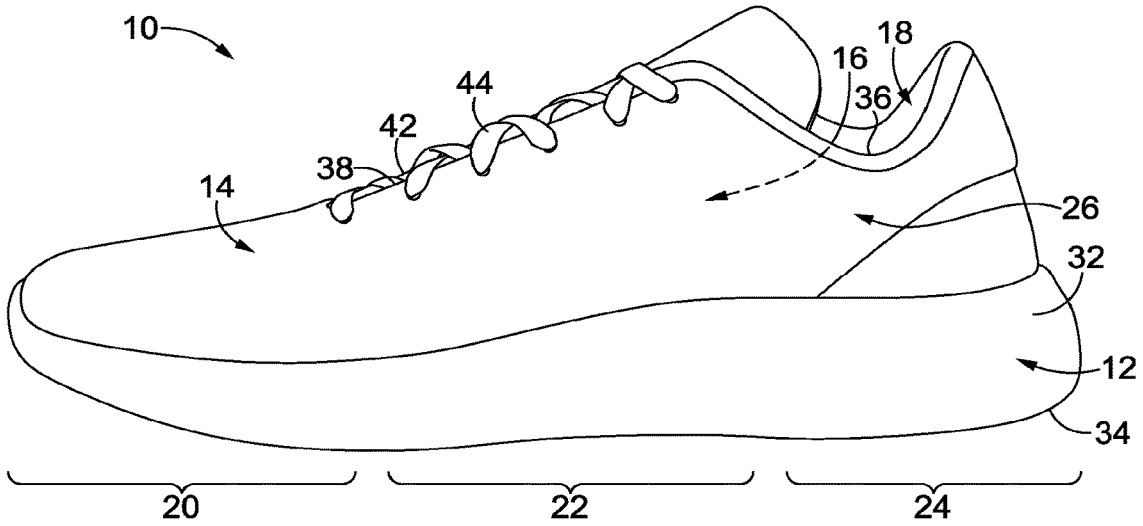
FIG. 1 depicts a side view of a footwear article in accordance with an aspect of this disclosure.

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present technologies or future technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

The subject matter described in this Specification generally relates to, among other things, a footwear article having a tongue and a tongue reinforcer, including manufactures, machines, and methods associated therewith. In some aspects, the tongue reinforcer helps the tongue maintain a shape and position when the tongue is subjected to forces or adjustments, such as from other footwear-article elements or from a wearer. For example, the tongue reinforcer may help the tongue maintain a shape and position when a wearer is inserting his or her foot into the footwear article or when medial and/or lateral quarters press inward on the tongue. Some aspects of this disclosure are directed to a footwear article with a tongue reinforcer and a collar elevator.

Before describing the figures in more detail, some additional explanation will now be provided related to certain terminology that may be used in this disclosure.

"A," "an," "the," "at least one," and "one or more" might be used interchangeably to indicate that at least one of the items is present. When such terminology is used, a plurality of such items might be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives might be employed throughout this detailed description corresponding to the illustrated examples. Ordinary skilled artisans will recognize that terms such as "above," "below," "upward," "downward," "top," "bottom," etc., may be used descriptively relative to the figures, without representing limitations on the scope of the invention, as defined by the claims.

The term "longitudinal," as possibly used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse," as possibly used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical," as possibly used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region, and/or a throat of an upper. The term "downward" or "downwards" refers to the vertical direction pointing opposite the upwards direction, toward the bottom of a component, and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as a shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

Figure 2:
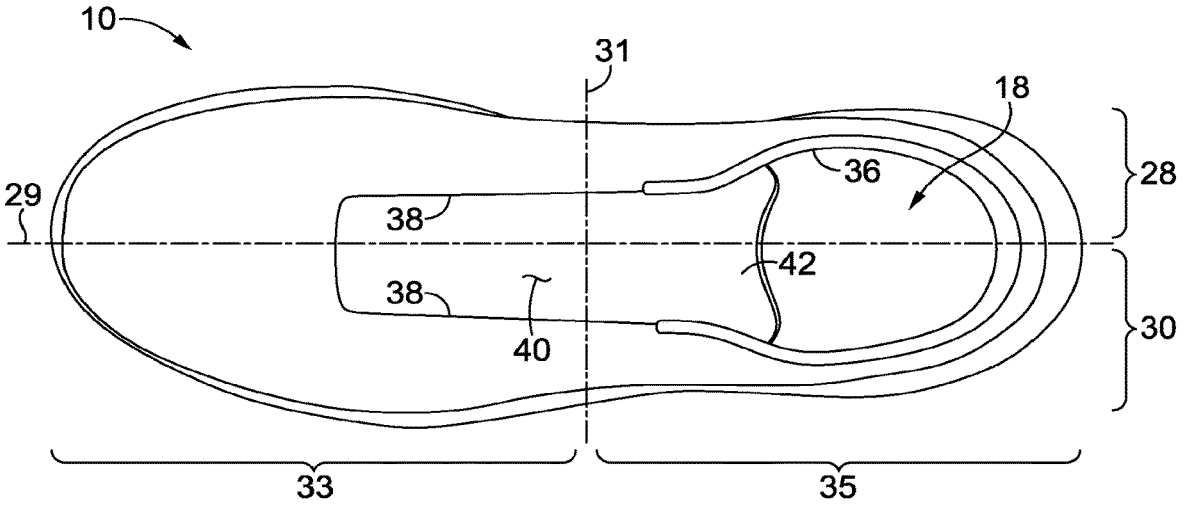
FIG. 2 depicts a top view of the footwear article of FIG. 1 in accordance with an aspect of this disclosure.

In order to aid in the explanation of, and understanding of, aspects of this Specification, reference is now made to FIGS. 1 and 2 to describe elements of a typical footwear article 10, which may include a tongue reinforcer. FIG. 1 depicts a lateral side of the footwear article 10, and FIG. 2 depicts a top of the footwear article. When describing the various figures mentioned in this disclosure, like reference numbers refer to like components throughout the views.

The footwear article 10 includes at least two primary elements including a sole structure 12 and an upper 14. When the footwear article 10 is worn (as intended on a foot), the sole structure 12 is typically positioned near the foot plantar surface (i.e., the bottom of the foot). The sole structure 12 may protect the bottom of the foot, and in addition, may attenuate ground-reaction forces, absorb energy, provide traction, and control foot motion, such as pronation and supination. The upper 14 is coupled to the sole structure 12, and together with the sole structure 12, forms a foot-receiving cavity 16. That is, while the sole structure 12 typically encloses the bottom of the foot, the upper 14 extends over, and at least partially covers, a dorsal portion of the foot (i.e., the top of the foot or the instep) and secures the footwear article 10 to the foot. The upper 14 includes a foot-insertion opening 18, through which a foot is inserted when the footwear article 10 is put on as the foot is arranged into the foot-receiving cavity 16.

As indicated in FIG. 1, the footwear article 10 may include a forefoot region 20, a midfoot region 22, a heel region 24, and an ankle region 26. The forefoot region 20, the midfoot region 22, and the heel region 24 extend through the sole structure 12 and the upper 14. The ankle region 26 is located in a portion of the upper 14. The forefoot region 20 generally includes portions of the footwear article 10 corresponding with the toes and the joints connecting the metatarsals with the phalanges. The midfoot region 22 generally includes portions of the footwear article 10 corresponding with the arch area and instep of the foot. The heel region 24 corresponds with rear portions of the foot, including the calcaneus bone. The ankle region 26 corresponds with the ankle. The forefoot region 20, the midfoot region 22, the heel region 24, and the ankle region 26 are not intended to demarcate precise areas of the footwear article 10, and are instead intended to represent general areas of the footwear article 10 to aid in the understanding of various aspects of this Specification. In addition, portions of a footwear article may be described in relative terms using these general zones. For example, a first structure may be described as being more heelward than a second structure, in which case the second structure would be more toeward and closer to the forefoot.

The footwear article 10 also has a medial side 28 (identified in FIG. 2 and obscured from view in FIG. 1) and a lateral side 30 (identified in FIG. 2 and viewable in FIG. 1). The medial side 28 and the lateral side 30 extend through each of the forefoot region 20, the midfoot region 22, the heel region 24, and the ankle region 26, and correspond with opposite sides of the footwear article 10, each falling on an opposite side of a longitudinal midline reference plane 29 of the footwear article 10, as is understood by those skilled in the art. For example, the longitudinal midline reference plane 29 may pass through the foremost point of the sole structure and the rearmost point of the sole structure. The medial side 29 is thus considered opposite to the lateral side 30. Typically, the lateral side corresponds with an outside area of the foot (i.e., the surface that faces away from the other foot), and the medial side corresponds with an inside area of the foot (i.e., the surface that faces toward the other foot). In another aspect, the footwear article includes an anterior portion 33 and a posterior portion 35, falling on an opposite side of a latitudinal midline reference plane 31 of the footwear article 10. The latitudinal midline reference plane 31 extends perpendicular to the longitudinal midline reference plane 29 and to the ground-surface plane and is spaced evenly between the foremost point of the footwear article 10 and the rearmost point of the footwear article 10. In addition, these terms may also be used to describe relative positions of different structures. For example, a first structure that is closer to the inside portion of the footwear article might be described as medial to a second structure, which is closer to the outside area and is more lateral.

In describing a footwear article, the relative terms "inferior" and "superior" may also be used. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface.

The sole structure 12 may be constructed of various materials and may include various elements. For example, the sole structure 12 may include a midsole 32 and an outsole 34. The midsole 32 may be formed from a compressible polymer foam element (e.g., a polyurethane or ethylvinylacetate (EVA) foam) that attenuates ground reaction forces (i.e., provides cushioning) when compressed between the foot and the ground during walking, running, or other ambulatory activities. In further aspects, the midsole 32 may incorporate fluid-filled chambers, plates, moderators, or other elements that further attenuate forces, enhance stability, or influence motions of the foot. The midsole 32 may be a single, one-piece midsole, or could be multiple components integrated as a unit. In some aspects, the midsole 32 may be integrated with the outsole 34 as a unisole. The outsole 34 may be one-piece, or may be several outsole components, and may be formed from a wear-resistant rubber material that may be textured to impart traction and/or may include traction elements such as tread or cleats secured to the midsole 32. The outsole 34 may extend either the entire length and width of the sole or only partially across the length and/or width.

The upper 14 may also be constructed of various materials and may include various features. For example, the upper 14 may be constructed of leather, textiles, or other synthetic or natural materials. Further, the upper 14 may be a knit textile, woven, braided, non-woven, laminate, or any combination thereof. The upper 14 may have various material properties related to breathability, stretch, flexibility, wicking, water resistance, and the like.

The upper 14 typically includes a portion that overlaps with, and is connected to, the sole structure 12, and the junction of this connection may be referred to as a biteline. In addition, the upper 14 may include a "strobel," which includes a material panel extending from the upper 14 and across at least a portion of a foot-facing surface of the sole structure 12, and the strobel may be used to hold the upper 14 on a last when the sole structure 12 is attached to the upper 14. Stated differently, the sole structure 12 that is integrated into the footwear article 10 includes a foot-facing surface, and in some instances, the upper 14 may include a panel (referred to as a strobel) that extends inward from near the biteline region and at least partially covers the foot-facing surface. In that instance, the strobel is positioned underneath a foot when the footwear article is worn. The strobel may be covered by an insole or other layer of material.

The upper 14 includes other features. For example, the upper 14 includes an ankle collar 36 that forms a perimeter around at least a portion of the foot-insertion opening 18. In addition, the upper 14 includes a throat 38 that often extends from the ankle collar 36 and forms a perimeter along at least one or more sides of an elongated opening 40. A tongue 42 is located in the elongated opening 40, and a size of the elongated opening 40 can be adjusted using various closure systems. For example, FIG. 1 illustrates laces 44, and other closure systems may include elastic bands, hook-and-loop straps, zippers, buckles, and the like. The position of the tongue 42 and the connections of the closure system can be adjusted to vary a size of the foot-insertion opening and the elongated opening, such as by making the openings larger when the footwear article is being donned or doffed and by making the openings smaller when the footwear article is being secured onto a foot. As will be described in other portions of this disclosure, the tongue 42 might include a tongue reinforcer, which might help the tongue maintain a shape and position when the tongue is subjected to forces or adjustments, such as from other footwear-article elements or from a wearer.

The footwear article 10 might include an athletic-type shoe, such as might be worn when running or walking, and the description of the footwear article 10, including the elements described with respect to FIGS. 1 and 2, might also be applicable to other types of shoes, such as basketball shoes, tennis shoes, American football shoes, soccer shoes, leisure or casual shoes, dress shoes, work shoes, a sandal, a slipper, a boot, hiking shoes, and the like.

Figure 3A:
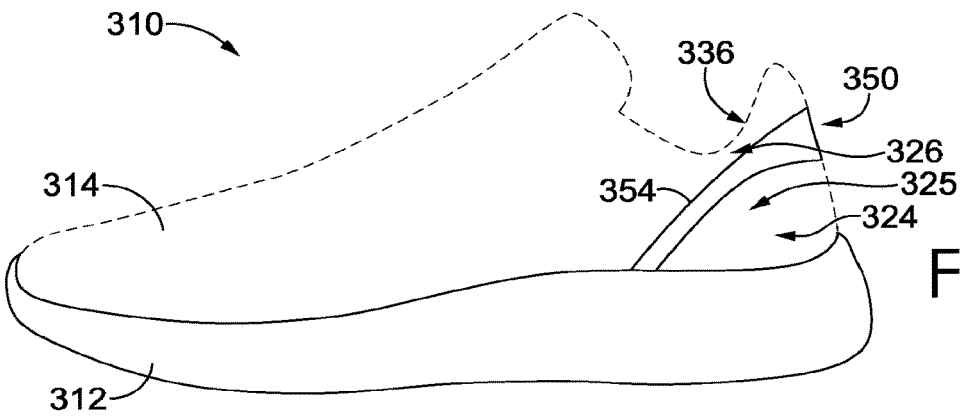
FIG. 3A-3C depict another footwear article having a collar elevator in accordance with an aspect of this disclosure.
Figure 3B:
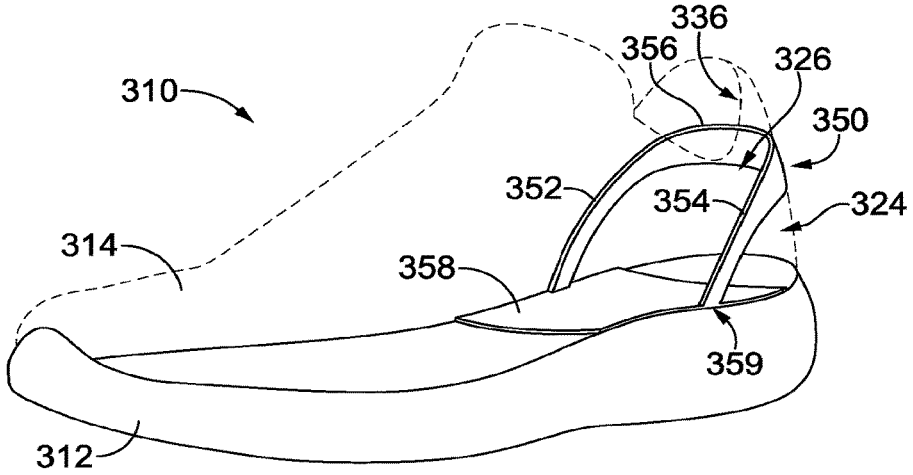
Figure 3C:
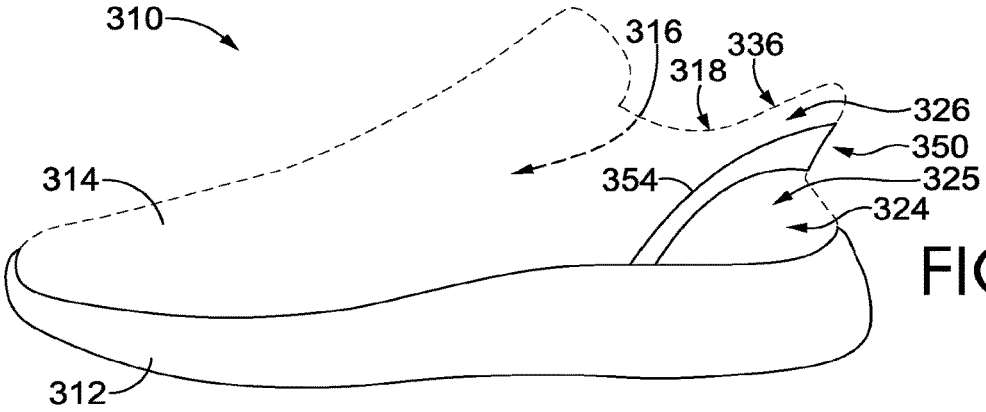

Having described FIGS. 1 and 2, reference is now made to FIGS. 3A-3C and 4A-4C to describe some other aspects of this disclosure. Each of FIGS. 3A, 3B, and 3C depicts a footwear article 310, which includes an upper 314 coupled to a sole 312, and the upper 314 includes a heel region 324 and an ankle region 326 with an ankle collar 336. The ankle collar 336 is movable between a lowered state (as depicted in FIG. 3C) and a raised state (as depicted in FIGS. 3A and 3B). In the lowered state, the ankle collar 336 is positioned closer to the sole 312, and in the raised state, the ankle collar 336 is positioned farther from the sole 312. Similarly, the footwear article 410 includes an upper 414 coupled to a sole 412, and the upper 414 includes a heel region 424 and an ankle region 426 with an ankle collar 436.

Figure 4A:
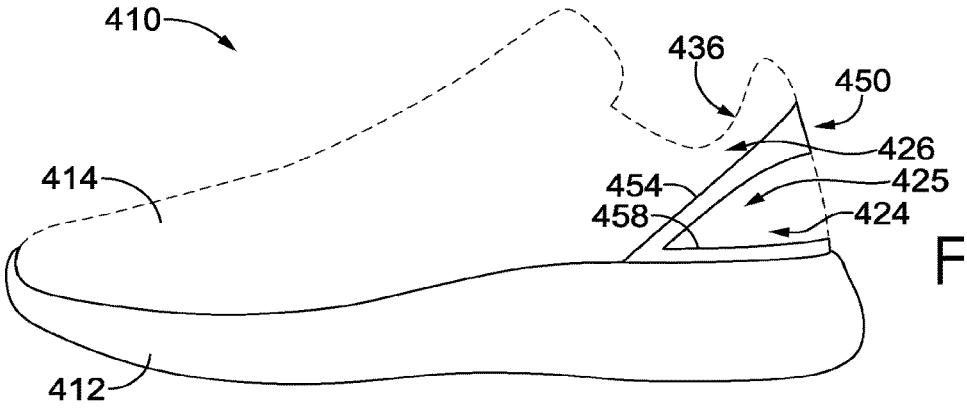
FIG. 4A-4C depict another footwear article having an alternative collar elevator in accordance with an aspect of this disclosure.
Figure 4B:
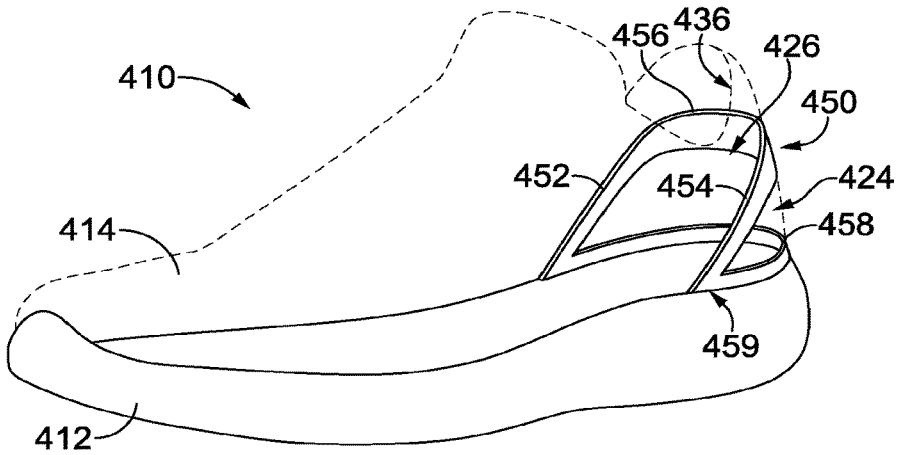
Figure 4C:
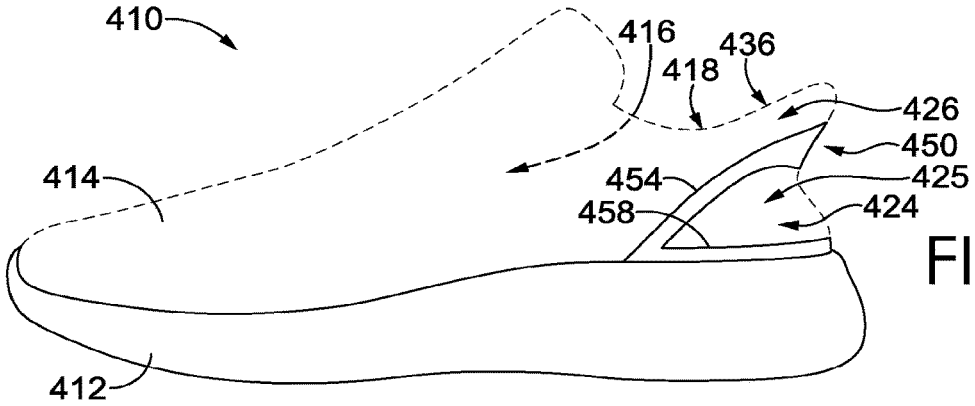
Figure 5:
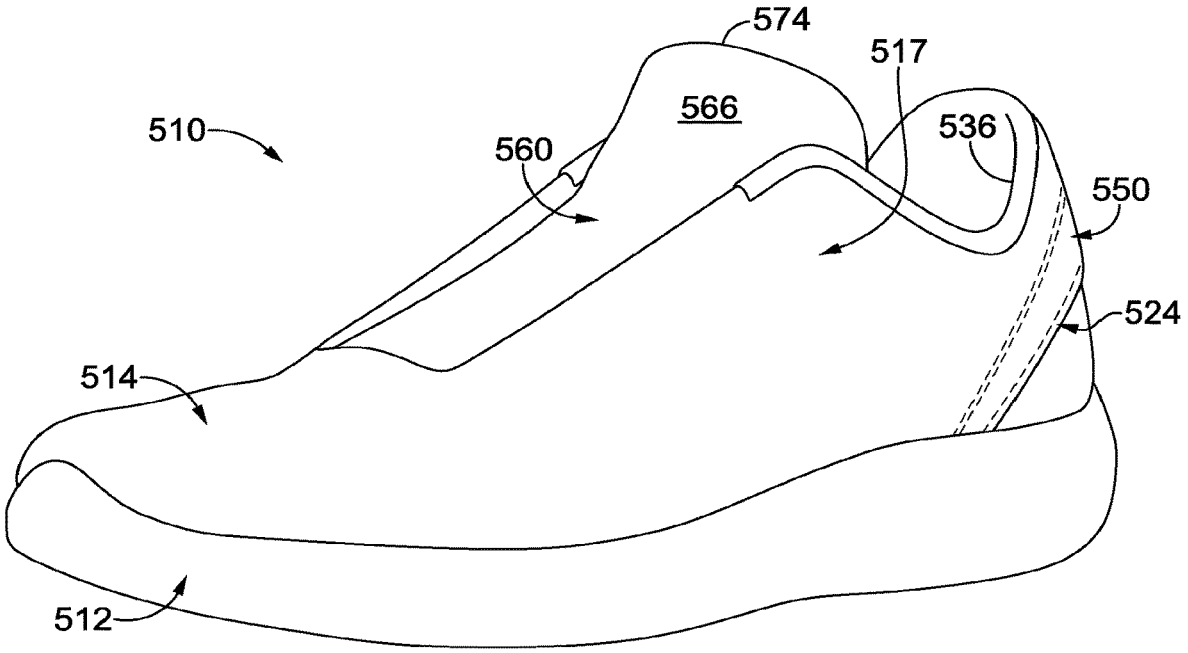
FIG. 5 depicts another footwear article in accordance with an aspect of this disclosure.

Furthermore, the footwear article 310 includes a collar elevator 350 that is coupled to the upper 314 near the heel region 324 and/or the ankle region 326 and that is operable to move the ankle collar 336 from the lowered state to the raised state. More specifically, the collar elevator 350 includes portions that are positioned in the heel region 324 and that extend up into the ankle region 326. As previously, indicated, there are not necessarily precise delineations between the heel region 324 and the ankle region 326; rather, describing the positioning of the collar elevator 350 with respect to these regions is one way to describe that the collar elevator 350 extends from a more inferior part closer to the sole to a more superior part closer to the ankle collar 336. As far as the coupling of the collar elevator 350 to the upper 314 near the heel region 324 and/or near the ankle region 326, this coupling may take various forms. For example, the collar elevator 350 may be coupled to the upper in the heel region 324, in the ankle region 326, to the ankle collar 336, or any and all combinations thereof. The collar elevator 350 is an example of one type of collar elevator operable to move an ankle collar from the lowered state to the raised state, and as will be described in other portions of this disclosure, a collar elevator may include one or more alternative structures than those depicted in FIGS. 3A-3C. For example, FIGS. 4A-4C depict a footwear article 410 with a collar elevator 450 that is operable to move the ankle collar 436 from the lowered state (e.g., FIG. 4C) to the raised state (e.g., FIGS. 4A and 4B) and that has a different structure from the collar elevator 350.

For illustrative purposes, the upper 314 and the upper 414 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

A collar elevator (such as the collar elevators 350 and 450) may include various elements. In one aspect, a collar elevator includes a medial lever arm, a lateral lever arm, and a center connecting band that couples the medial lever arm to the lateral lever arm and that is located in a heel portion of the ankle collar. In a further aspect, each lever arm is affixed to a base, which remains stationary relative to the lever arms as the lever arms deform when the ankle collar is moved to a lowered state. The base may be a portion of the footwear article, such as a portion of the sole or a portion of the upper. In addition, the base may be one or more other anchors affixed directly or indirectly to the sole, the sole itself, or any combination thereof. U.S. Pat. No. 9,820,527 describes one or more collar elevators, some of which may be referred to as a deformable member or as deformable members (with or without a base), and the full disclosure of U.S. Pat. No. 9,820,527 is incorporated herein by reference in its entirety. In accordance with an aspect of this disclosure, at least some of the deformable members described in U.S. Pat. No. 9,820,527 include a medial lever arm, a lateral lever arm, and a center connecting band that couples the medial lever arm to the lateral lever arm. In other examples, US 2018/0110292 and US 2018/0289109 each describes a plurality of other collar elevators, some of which are referred to as a control bar (with or without a base), and the full disclosures of US 2018/0110292 and US 2018/0289109 are incorporated herein by reference in their entirety. In accordance with an aspect of this disclosure, at least some of the control bars described in US 2018/0110292 and US 2018/0289109 include a medial lever arm, a lateral lever arm, and a center connecting band that couples the medial lever arm to the lateral lever arm.

Each of the illustrated collar elevators 350 and 450 depicts examples of medial lever arms 352 and 452, respectively. In addition, each of the illustrated collar elevators 350 and 450 depicts examples of lateral lever arms 354 and 454, respectively, and center connecting bands 356 and 456, respectively. Furthermore, the lever arms 352 and 354 attach to a base 358, and the lever arms 452 and 454 attach to a base 458 having a different structure from the base 358. The base 358 is affixed to or near a foot-facing surface of the sole 312, and the base 358 might be a portion of an outsole, a portion of a midsole, a portion of an insole, a portion of a strobel, a plate or sheet of material layered between any of these sole layers, or any combination thereof. Among other things, the base 358 might include a rigid portion or section to which the lever arms 352 and 354 are anchored. FIGS. 4A-4C depict a different aspect, in which the base 458 might attach to a portion of the upper (e.g., a heel counter), a portion of the midsole sidewall, or any combination thereof, and the base 458 wraps around a backside of the footwear article, as opposed to extending through the footbed in the manner described with respect to the base 358.

The medial lever arm, the lateral lever arm, and the center connecting band may be a single continuous body, such that clear demarcation may not exist between the medial lever arm, the lateral lever arm, and the center connecting band. For example, the medial and lateral arms and the center connecting band may be molded, cast, 3D printed, or otherwise formed as a single, integrally formed unit. In other aspects, the medial lever arm and the lateral lever arm may be discrete, separate, and distinct elongated members, which are connected to the center connecting band, such as by a mechanical or chemical coupling, a friction fit, sheathing, or other coupling.

Having generally described some of the structural elements of a collar elevator, some operational aspects of a collar elevator will now be described. As briefly described above, the collar elevator moves the ankle collar from the lowered state to the raised state. More specifically, at least a portion of the medial lever arm, the lateral lever arm, the center connecting band, or any combination thereof, is affixed to a portion of the upper. In one aspect, the center connecting band may be affixed near a heel portion of the ankle collar. For example, as described in other portions of this disclosure, the center connecting band may be attached to the heel portion of the ankle collar by an adhesive, connection tab, heat stake, stitch, and the like. As such, when the ankle collar is moved to a lowered state closer to the sole, the medial lever arm and the lateral lever arm deform to a more compressed or more loaded position. Stated differently, the collar elevator stores potential energy by elastically deforming from a less compressed configuration (e.g., FIGS. 3A and 4A) to a more compressed configuration (e.g., FIGS. 3C and 4C) when an applied force moves the ankle collar from the raised state to the lowered state. The potential energy returns the collar elevator to the less compressed configuration upon removal of the applied force, and since the collar elevator is affixed to the upper, the ankle collar is also moved from the lowered state to the raised state. While the compression of the collar elevator may be greater when the ankle collar is moved to the lowered state (as compared with the raised state), in the raised state the collar elevator may still store potential energy in an at least partially deformed state (i.e., preloaded compression) so as to be able to hold a rear, heel portion of the ankle collar about the heel of the wearer. For example, if the collar elevator is attached to the upper heel region and/or the upper ankle region, then portions of the upper may hold or retain the collar elevator in the preloaded configuration when the ankle collar is in the raised state. In other aspects, the collar elevator may be unloaded when the ankle collar is in the raised state.

In one aspect, the portion 325 or 425 of the upper below the center connecting band may include wall of one or more textiles that are more flexible than other portions of the upper. This more flexible region of the upper may, for example, be at least partially in the heel-counter region. Among other things, this more flexible portion 325 or 425 of the upper may collapse more easily when the ankle collar is moved to a lower state and may provide less resistance for the collar elevator (as compared with a less flexible upper in other parts of the footwear article or in a typical footwear article) when the collar elevator is returning to the less compressed state.

In some aspects, the combination of the medial lever arm, the lateral lever arm, and the center connecting band may be referred to as a deformable element. The term "deformable element" refers to a resiliently flexible member that can be bent or compressed but has a bias to move towards a non-bent or uncompressed state. The deformable element may include a single, integrally formed, deformable element, extending continuously from the medial lever arm to the lateral lever arm. In other aspects, the medial lever arm and the lateral lever arm may be two or more separate and distinct deformable elements that connect to the center connecting band, which may also be referred to as a heel piece.

In some aspects, the deformable element might be directly coupled, mounted, or attached to the base. In other aspects, the base may include one or more anchors that engage and retain the deformable element in place. For example, anchors may be located at a junction (e.g., 359 and 459) between the lever arms and the base. Such anchors might be integrally formed with, coupled to and/or located within or between or outside of portions of the sole (e.g., insole, midsole, outsole). For example, an anchor may be disposed in a block, plate, or wedge layered among, on top, or beneath the sole. In some instances, a portion of the sole (e.g., midsole) might be carved or cut out to attach to or house an anchor. In another aspect, a base extending in the mediolateral orientation (e.g., base 358) includes an anchor-shaped receptacle into which an anchor engages by way of a resistance fit, compression fit, a snap fit, or via an interlocking mechanism/configuration. In other examples, the anchors may be integrally formed with, coupled to, and/or located within, between, or outside of portions of the upper. For example, anchors may be located in the upper, in a heel counter, or any combination thereof. A single anchor may extend a full width of the footwear article, or two anchors may be positioned on opposing sides of the footwear article (e.g., on the medial and lateral sides). The deformable member may attach to the base or to an anchor at an angle. For example, the deformable member might attach at a perpendicular angle to the base and then curve or arc rearwardly. In another aspect, the deformable member might attach at a forwardly inclining angle (i.e., upwards and forwards) or a rearwardly reclining angle (i.e., upwards and rearwards) before rearwardly arcing.

A connection between the deformable member and the base or the anchors may be described in various manners. For example, in one aspect, the deformable element does not pivot (i.e., is non-pivoting) about the base (e.g., about an insole, midsole, or outsole). Described differently, the deformable element may be non-rotatably coupled to the base. In various aspects, engagement between the deformable element and the base (or anchor) is free of play, meaning that there is little or no relative movement between the two components.

A deformable element may include one or more of a tube, a wire, a spring, a shape memory structure or material, and the like. Furthermore, a deformable element can include one or more materials such as carbon steel, stainless steel, titanium, nickel titanium (nitinol) and other metals and alloys (shape-memory or otherwise), polymers (shape-memory or otherwise), composite materials, foam materials, graphite, carbon fiber, fiberglass, TPC-ET, silicone, TPU, and polycarbonate. For example, a deformable element might include titanium or be a titanium wire. Also, one or more deformable elements might be made of a first material, e.g., titanium, and one or more additional deformable elements might be made of a second material, e.g., graphite.

In some aspects, the deformable element might include a single, unitary piece. For instance, a first end of the deformable element (e.g., an end of the medial lever arm) might be embedded in, or attached to, a medial anchor; a second end of the deformable element (e.g., an end of the lateral lever arm) might be embedded in or attached to a lateral anchor; and a middle portion of the deformable element (e.g., the center connecting band) might extend around the heel portion or ankle portion of the upper, or be embedded within some additional heel-piece structure.

In other aspects, the deformable element might include a plurality of separate and distinct components. For instance, a deformable element might include two separate components, with a first component (e.g., medial lever arm) having a first end embedded in or attached to a medial anchor and a second end embedded in or attached to the medial side of a heel piece or center connecting band. As such, a second component (e.g., lateral lever arm) might similarly include a first end embedded in or attached to a lateral anchor and a second end embedded in or attached to the lateral side of the heel piece or center connecting band. The plurality of separate and distinct components can be secured together, for example, with one or more of a tape wrap, woven encasing, overmold (e.g., TPU), heat shrink tube, and the like, each of which can provide different stabilities and strengths. For example, a deformable element might include one or more wires encased independently or encased together in a cover, sleeve, overmold, or heat shrink tube. The one or more wires can arch, bend, and sway and then return to an initial/normal state in order to help facilitate the elastic deformation of the deformable element.

A deformable element might have variable mechanical properties along its length and/or at distinct points along its length. Such variation might be provided by the deformable element (e.g., by a wire or bundle of two or more wires), by a securement surrounding all or a portion of the deformable element(s), or any combination thereof. For example, the deformable element and/or the securement might have a variable cross-section, a variable density, a variable material, and/or the like along its length. A variable cross-section, in turn, can be provided by variation in thickness or shape, or twisting of the deformable element otherwise having a constant thickness or shape along its length.

As briefly described above, a deformable element may include a cover, sleeve, overmold, or other suitable structure, which might protect other elements (e.g., wire, spring, etc.) of the deformable element and might control, guide, support and/or otherwise affect the flexure or compression of the deformable element. In some aspects, the cover, based on its material of manufacture, shape, geometry, etc., is configured to facilitate mechanical stress distribution by transferring mechanical bending/deforming forces from the deformable element (e.g., from the wire(s) or spring) to the cover to prevent, or at least inhibit, the deformable element from damage or breakage that may otherwise result from the concentrated and repeated mechanical stress experienced by the deformable element. For example, the cover may have dimensions that vary along its length, such as a funnel-like tapering shape, to help distribute stress and contribute to the dynamic flexing of the deformable element. In the event that the deformable element breaks, the cover might still provide at least some degree of bias, thereby still helping to move the ankle collar from the lowered position to the raised position. Further, the cover may provide additional padding and/or support to the deformable element and may prevent, or at least inhibit, a wearer from feeling the deformable element.

As briefly described above, the center connecting band may also be referred to as a heel piece. The center connecting band may be integrally formed with the medial and lateral lever arms, as a single, continuous unit. In other aspects, the center connecting band may be a separate piece that extends between, and bridges, the medial and lateral lever arms. Among other things, the center connecting band may provide a coupling to the upper and may provide a frame to the ankle collar, to inhibit the ankle collar from collapsing into the foot-receiving opening when a foot is being inserted.

When being put on by a wearer, a footwear article with a collar elevator (e.g., collar elevators 350 and 450) might be slipped on by the wearer without the wearer using his or her hands to manipulate the footwear article. For example, the wearer's toes may be inserted through the foot-insertion openings 318 or 418, while the arch or heel of his or her foot is used to press downward on the ankle collars 336 or 436 towards the soles 312 or 412. This adjustment of the ankle collar 336 or 436 into the lowered state closer to the sole may increase a size of the foot-insertion opening 318 or 418. Once the wearer's foot has been slid into the foot-receiving cavity 316 or 416, the collar elevator 350 or 450 moves the ankle collar from the lowered state (i.e., FIGS. 3C and 4C) to the raised state (i.e., FIGS. 3A and 4A) to help secure the footwear article to the wearer's foot.

Among other things, the collar elevators 350 and 450 may reduce potential structural breakdown of the upper heel region and upper ankle region over time, which could result from repeated hands-free donning, by providing a frame operational to return to, or bias in, the raised state. Furthermore, the collar elevators 350 and 450 may allow the user to more easily don (i.e., put on) his or her shoes without the use of hands and/or without having to bend down to tie the laces, without having to use a shoe horn, or without using other such adjustment features, elements, or mechanisms for fit. Moreover, the footwear articles 310 and 410 may more easily receive, or more easily direct a wearer's foot into, or otherwise accommodate, a wearer's foot with respect to, the foot-receiving opening. This potentially easier donning may result from, among other things, the collar elevators 350 and 450 helping to provide a larger foot-insertion opening without allowing a topline of the ankle collar to fold inward towards the foot-receiving cavity.

Operation of the footwear articles 310 and 410 may be described in various manners. For example, the ankle collars 336 and 436 may be elastic or may include a goring element that permits expansion of the foot-insertion openings 318 and 418, such as when the ankle collar is moved to a lowered state. In the lowered state, the foot-insertion openings 318 and 418 may be expanded by at least about 5%, or at least about 10%, or at least about 15%. This measured expansion may be detected in various manners. For example, a first circumference of the foot-insertion opening may be measured when the ankle collar is in a first state, and a second circumference may be measured when the ankle collar is in a second state, which is closer to the sole (relative to the first state). The distance of the ankle collar from the sole in the first and second states may be measured in a vertical plane (i.e., perpendicular relative to the horizontal reference plane, including a flat ground surface on which the ground-contacting surface sits in an at-rest position), and the distance may be measured from a rearmost point of the ankle collar topline edge to a topline edge of the sole (e.g., where the sole connects to the upper at the biteline). As such, the distance in the first state will be longer than the distance in the second state, and in one aspect, the second distance is equal to or shorter than 75% of the first distance. Continuing with the above example, in the second state having the distance equal to or shorter than 75% of the distance in the first state, the circumference may be expanded by at least about 5%, or at least about 10%, or at least about 15%. In a further example, a circumference of the foot-insertion openings 318 and 418 may be expandable by at least about 1.0 inch (about 2.54 centimeters), when the ankle collar is in the second state having the distance equal to or shorter than 75% of the distance in the first state. An amount of the expansion of the foot-insertion opening 318 and 418 may vary with the shoe style and size. In other aspects, a height of the ankle collars 336 and 436 above the soles 312 and 412 in the lowered state is about 50% lower than the height in the raised state, however, as with other parameters, this may vary depending on the shoe style and size.

As described in other portions of this disclosure, the collar elevators 350 and 450 provide a return force when moving the ankle collars 336 and 436 from the lowered state to the raised state. In some aspects, the return force is between about 1 pound-force and about 15 pound-force, and this may be measured at various positions of the ankle collar. For example, as explained above, the ankle collar may include a first state having a first distance from the sole and a second state having a second distance from the sole, which is shorter than the distance in the first state. In one aspect, the collar elevators 350 and 450 provide the return force between about 1 pound-force and about 15 pound-force in the second state having the distance equal to or shorter than about 85% of the distance in the first state. In a further aspect, the collar elevators 350 and 450 provide the return force between about 1 pound-force and about 15 pound-force in the second state having the distance equal to or shorter than about 75% of the distance in the first state. Further still, the collar elevators 350 and 450 might provide the return force between about 1 pound-force and about 15 pound-force in the second state having the distance equal to or shorter than about 50% of the distance in the first state. The return force may be strong enough such that the rear of the ankle collar rebounds back up from the second state and snugly fits around the wearer's heel. For example, the ankle collars 336 and 436 may be elevated from the lowered state to the raised state in less than about 1 second, when the distance between the ankle collar and the sole in the lowered state is shorter than 85%, or shorter than 75%, or shorter than 50% of the distance in the raised state. In other aspects, ankle collars 336 and 436 may be elevated from the lowered state to the raised state in less than about 0.5 seconds, when the distance between the ankle collar and the sole in the lowered state is shorter than 85%, or shorter than 75%, or shorter than 50% of the distance in the raised state. And in further aspects, the ankle collars 336 and 436 may be elevated from the lowered state to the raised state in less than about 0.2 seconds, when the distance between the ankle collar and the sole in the lowered state is shorter than 85%, or shorter than 75%, or shorter than 50% of the distance in the raised state. This rebound time is measured absent any counteracting external forces, such as friction that might be imparted by the wearer's heel.

Referring now to FIGS. 5-9, 10A-10D, 11, and 12 another footwear article 510 is described having an upper 514 coupled to a sole 512. The upper 514 includes a medial quarter 515, and portions of the medial quarter 515 can be seen in FIGS. 9, 10A-10D, and 11. For example, the exterior of the medial quarter 515 can be seen in the top view FIG. 9, and the interior of the medial quarter 515 can be seen in the cross-sectional view of FIG. 11. In addition, FIGS. 10A-10C also identify the medial quarter 515. The upper 514 also includes a lateral quarter 517, and portions of the lateral quarter 517 can be seen in various different figures. For example, the exterior of the lateral quarter 517 is identified in the lateral, front-perspective, view of FIG. 5 and in the top view of FIG. 9. In addition, FIGS. 10A-10C also identify the lateral quarter 517.

The footwear article 510 also includes a heel region 524 having an ankle collar 536. The ankle collar 536 is movable between a lowered state (e.g., FIG. 7) positioned closer to the sole 512 and a raised state (e.g., FIG. 5) positioned farther from the sole 512. In addition, the footwear article 510 includes a collar elevator 550 coupled to the heel region 524 and operable to move the ankle collar 536 from the lowered state to the raised state. The collar elevator 550 that is illustrated in FIGS. 5-8 is an example of one type of collar elevator, and in other aspects of this disclosure, the footwear article 510 may include any of a variety of other collar elevators disclosed in this specification.

Figure 6:
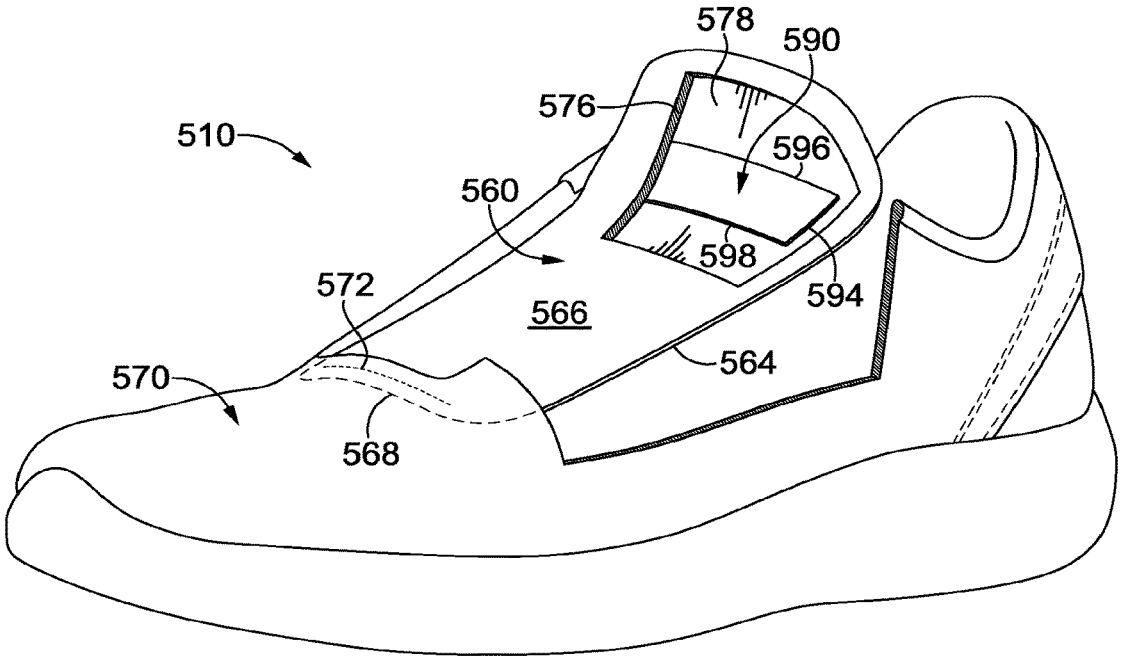
FIG. 6 depicts the footwear article of FIG. 5 with a portion of the tongue cut away in accordance with an aspect of this disclosure.
Figure 7:
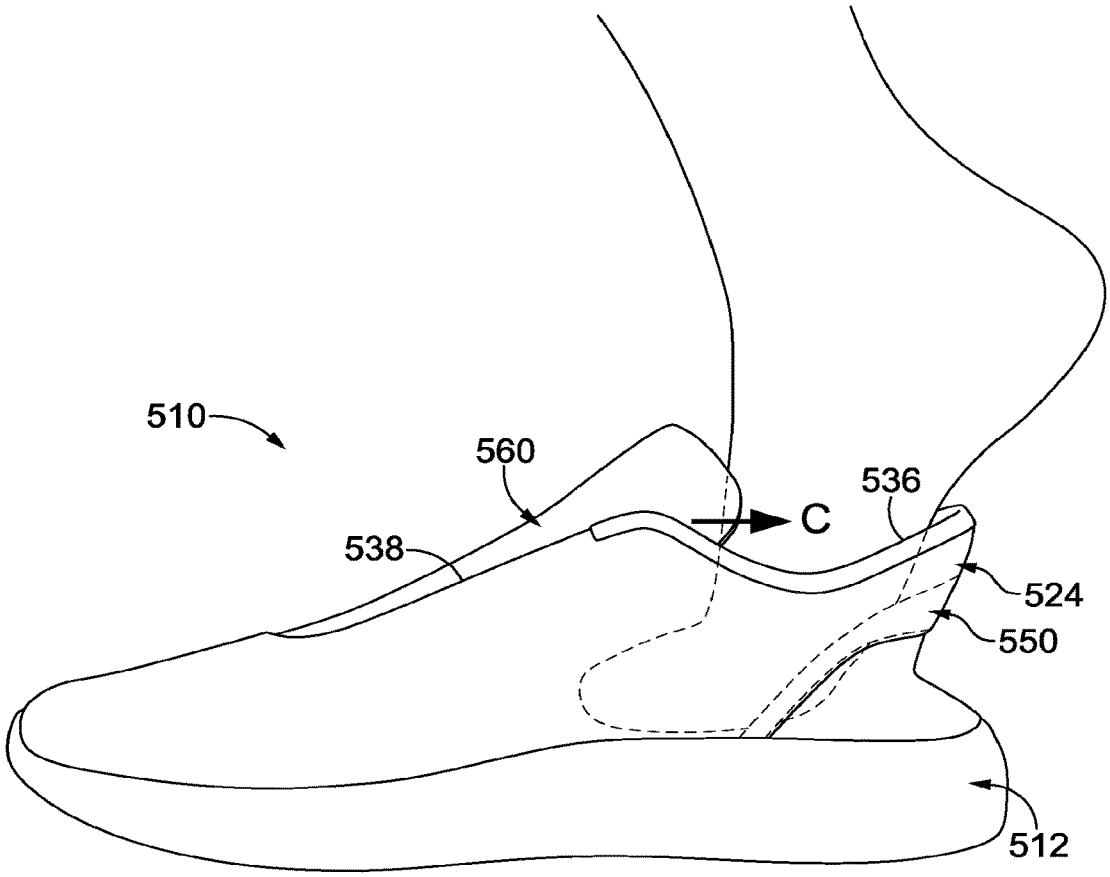
FIG. 7 depicts the footwear article of FIG. 5 with the ankle collar in a lowered state in accordance with an aspect of this disclosure.

The footwear article also includes a tongue 560 having a medial edge 562, a lateral edge 564, and an outward-facing surface 566. Although at least some portions of the medial and lateral edges of the tongue may be obscured from view in a typical, as-worn configuration, the figures depict the tongue edges in various manners. For example, the medial edge 562 is identified in the cross-sectional views of FIGS. 10A-10D and in FIG. 11. In FIG. 6, a portion of the lateral quarter has been cutaway to reveal the lateral edge 564, and the lateral edge 564 is also identified in the cross-sectional views 10A-10D. The tongue 560 also includes a foremost edge 568 that is obscured by the forefoot vamp portion 570 of the upper 514 and that is shown in broken lines in FIG. 6. In one aspect, one or more connectors 572 (e.g., stitch, bonding, integral formation, etc.) may be positioned near the foremost edge 568 provide a coupling between the tongue 560 and the upper 512. The tongue 560 also includes a topline edge 574 along a rearmost portion of the tongue 560.

Figure 8:
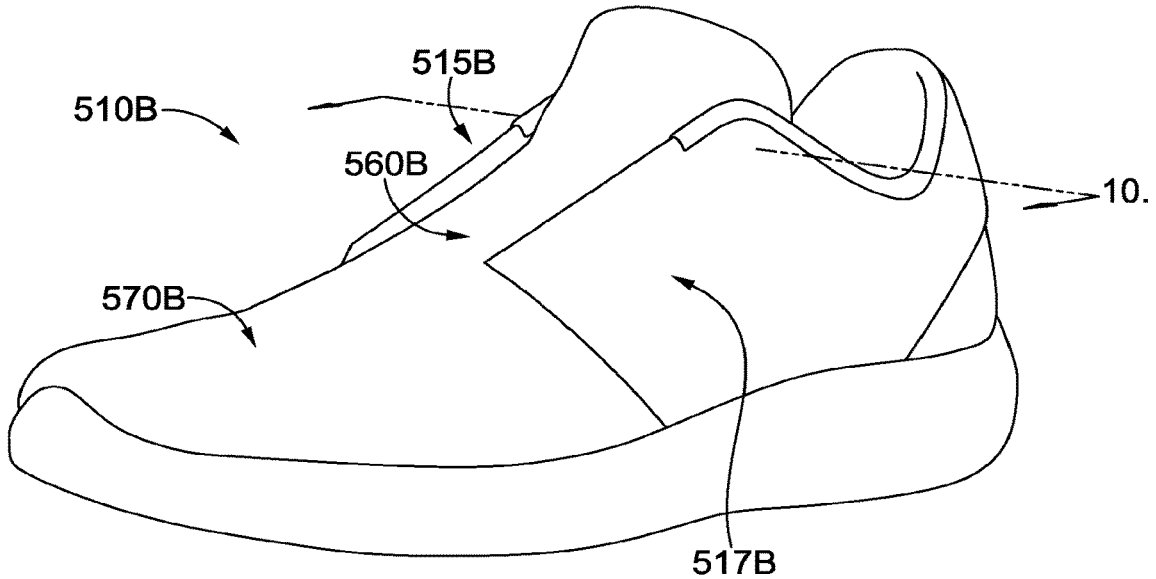
FIG. 8 depicts an alternative footwear article having a different tongue than the footwear article in FIG. 5 in accordance with an aspect of this disclosure.

The tongue 560 of the footwear article 510 is an example of one type of tongue, and in other aspects, the tongue may be integrally formed with the forefoot vamp portion of the upper, such that the upper continuously extends from the forefoot vamp portion to the tongue topline edge. FIG. 8 illustrates an example of this type of tongue configuration, in which the tongue 560B continuously extends with the forefoot vamp portion 570B, which may be a separate panel from the medial quarter 515B and the lateral quarter 517B. Unless otherwise explicitly described to the contrary or clearly indicated from the context, the portions of this description related to the tongue 560 are equally applicable to the tongue 560B. For example, the cross-sectional views of FIGS. 10A-10D would be equally accurate and applicable for both the footwear article 510 and the footwear article 510B. Examples of differences between the tongue 560 and the tongue 560B might include the presence of a foremost edge (e.g., 568) and a tongue length that is measured from the foremost edge 568 to a topline edge 574. As may be described in other portions of this disclosure, a length of the tongue 560B may be determined using a different technique.

The tongue 560 generally includes a panel of one or more layers of material. For example, the tongue 560 may include a knit, woven, braided, laminate, or non-woven textile panel. For example, FIGS. 10A-10D and FIG. 11 represent a cross sectional view of the tongue 560 and the tongue 560B and identify a tongue exterior layer 576 and a tongue interior layer 578. The tongue exterior layer 576 includes an inward-facing surface 567 that faces towards the foot-receiving cavity. In addition, the tongue 560 may include a first layer and a second layer, with a cushion layer therebetween. Although depicted as single layers, each of the layers 576 and 578 may alternatively each include a plurality of layers. As described in other portions of this disclosure, the tongue 560 is positioned in the throat of the footwear article and helps to cover the elongated opening, among other things. The multi-layer tongue illustrated is an example of one type of tongue, and in other aspects, the tongue may include a single material layer, such as a single knit layer, a single woven layer, a single braided layer, a single layer of non-woven material, a single layer of laminate material, and the like.

Figure 10A:
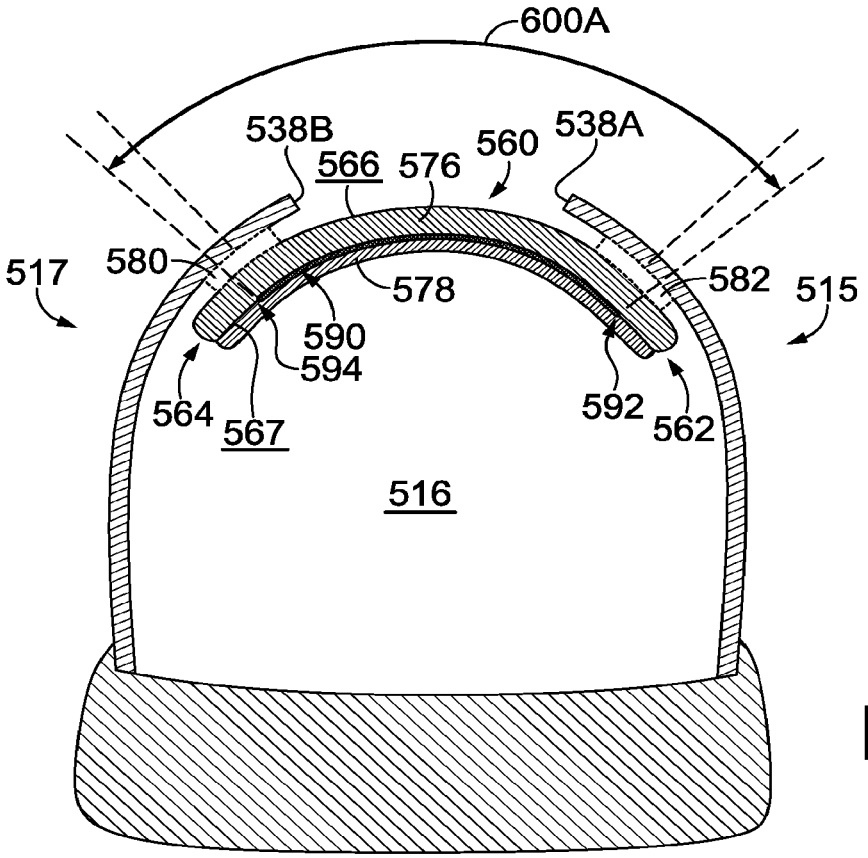
FIGS. 10A-10D depict various cross-sectional views of a tongue in accordance with an aspect of this disclosure.

In another aspect of the disclosure, the footwear article 510 includes a lateral-side connector 580 attaching the outward-facing surface 566 to the lateral quarter 517 and a medial-side connector 582 attaching the outward-facing surface 566 to the medial quarter. For example, FIG. 10A depicts a cross-sectional view showing an interface between the outward-facing surface 566 and the quarters 515 and 517, as well as a illustrative a position of the connectors 580 and 582.

In an aspect of the disclosure, the medial-side connector 582 and the lateral side connector 580 may transfer forces between the tongue 560 and the medial quarter 515 and the lateral quarter 517. For example, in some instances, the upper 514 may be shaped in such a way that the medial quarter 515 and the lateral quarter 517 lean, or are biased, inwards towards the foot-receiving cavity, in the directions indicated by arrows E and F. This inward lean or bias may result from a shape of the upper, from a manner in which the upper is lasted, from gravity, or from any and all combinations thereof. Furthermore, this inward lean applies a shearing force against the tongue that is transferred through the medial and lateral connectors.

Figure 9:
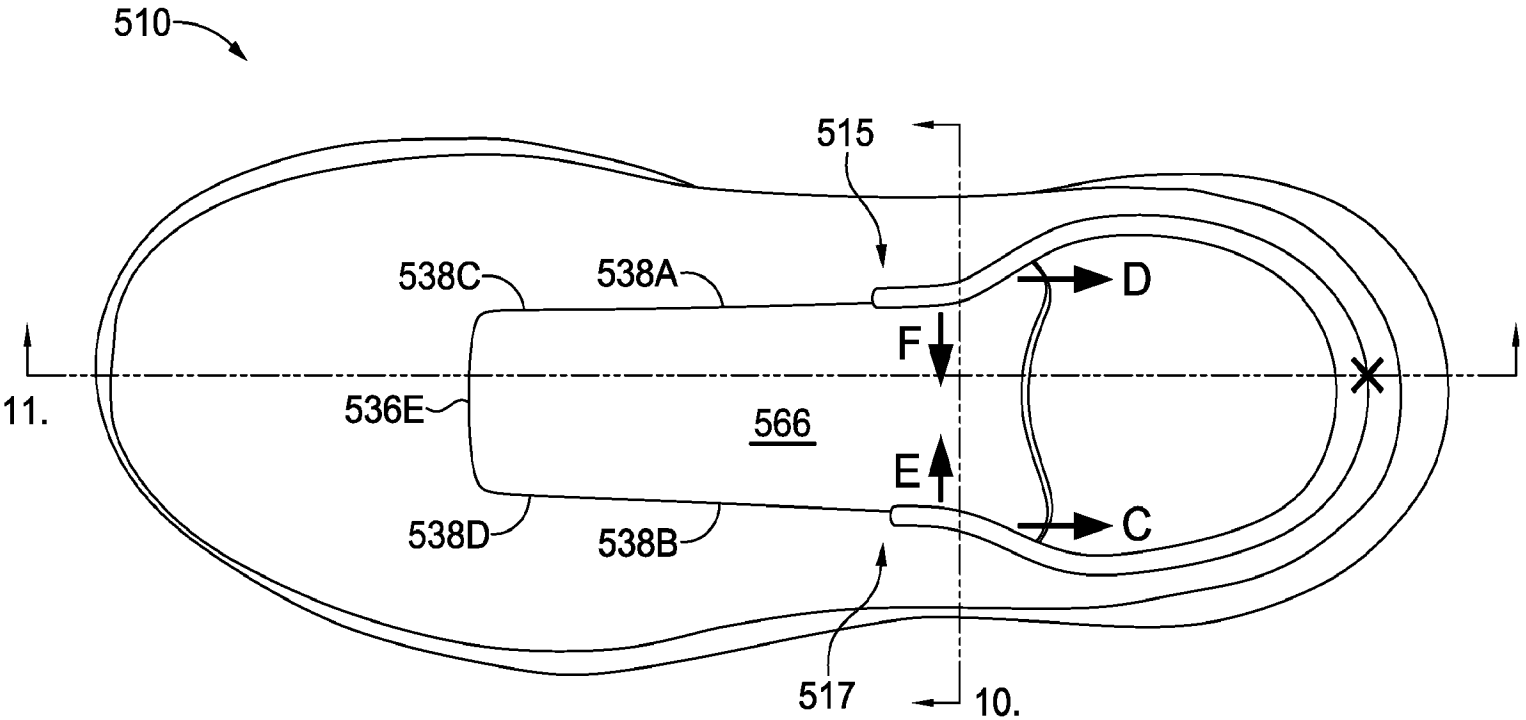
FIG. 9 depicts a top view of the footwear article in FIG. 5 in accordance with an aspect of this disclosure.

In other instances, the medial and lateral quarters 515 and 517 may collapse inwards when the ankle collar 536 is depressed into the lowered state, such as when a wearer is slipping his or her foot through the foot-insertion opening. For example, depression of the ankle collar 536 may in turn pull on the throat edges 538A and 538B. Referring to FIG. 9, when the ankle collar 536 is depressed near the X, the throat edges 538A and 538B may be pulled rearward and inward, as illustrated by the arrows C, D, E, and F. This in turn may collapse the medial and lateral throat edges 538A and 538B (and the medial and lateral quarters) towards one another. As such, this inward collapse by the throat edges and the quarters towards one another applies a shearing force against the tongue that is transferred through the medial and lateral connectors.

Figure 10B:
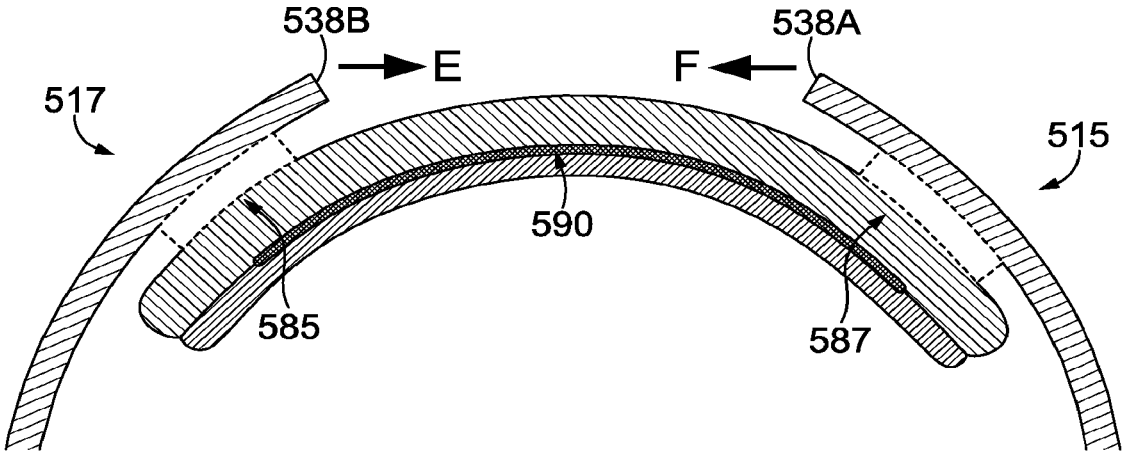

In an aspect of this disclosure, the tongue 560 includes a lateral-side, shear-force region 585 and a medial-side, shear-force region 587 (see e.g., FIG. 10B). The shear-force regions represent respective portions of the tongue 560 to which shearing forces are directed from the quarters. In one aspect, the shear-force region includes at least a portion of the outward-facing surface 566. The position of the shear-force region may vary depending on different factors, such as the type of connector and the size of the connector.

Figure 10C:
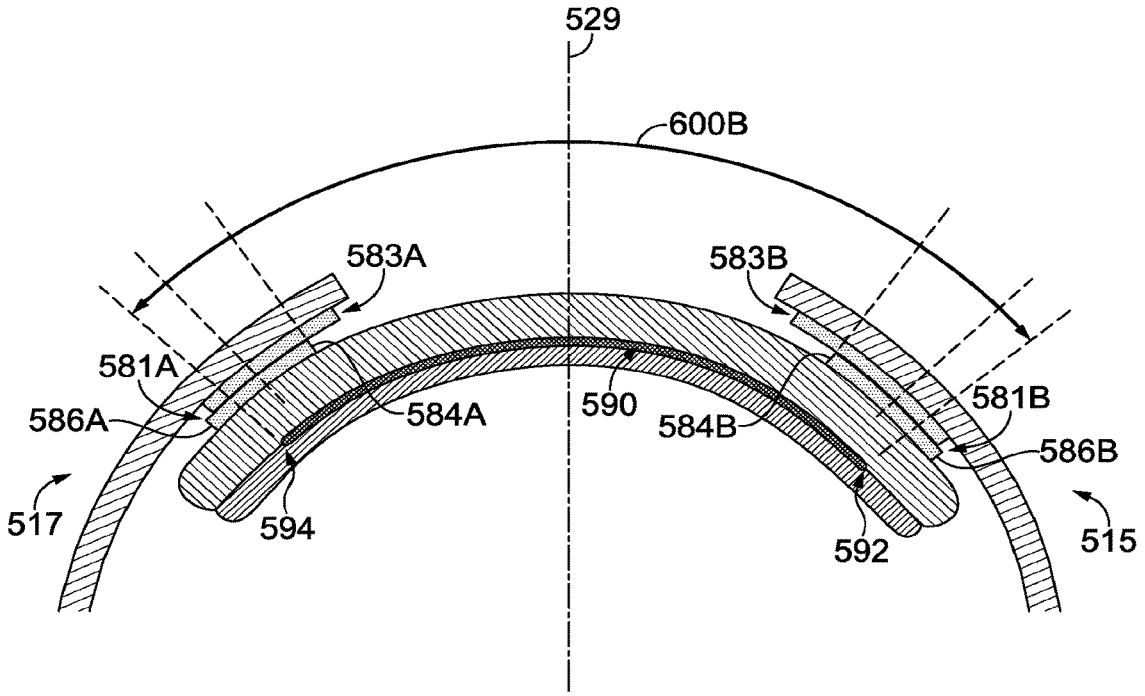
Figure 12:
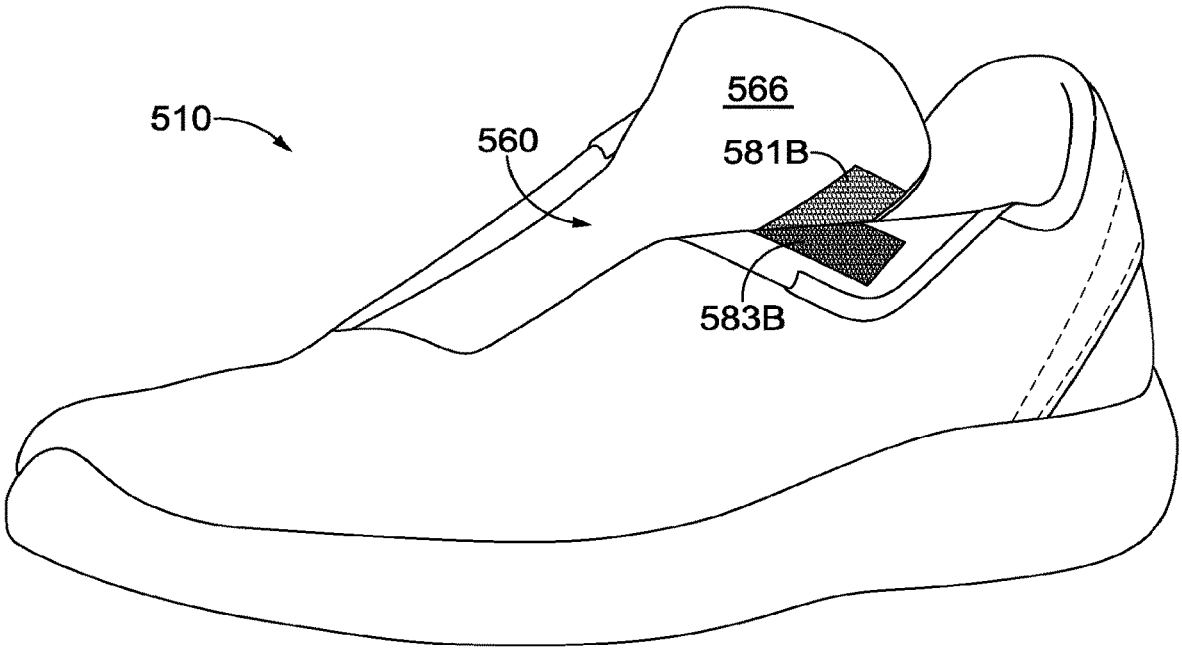
FIG. 12 depicts an example of a footwear article with hook-and-loop connectors in accordance with an aspect of this disclosure.
Figure 13:
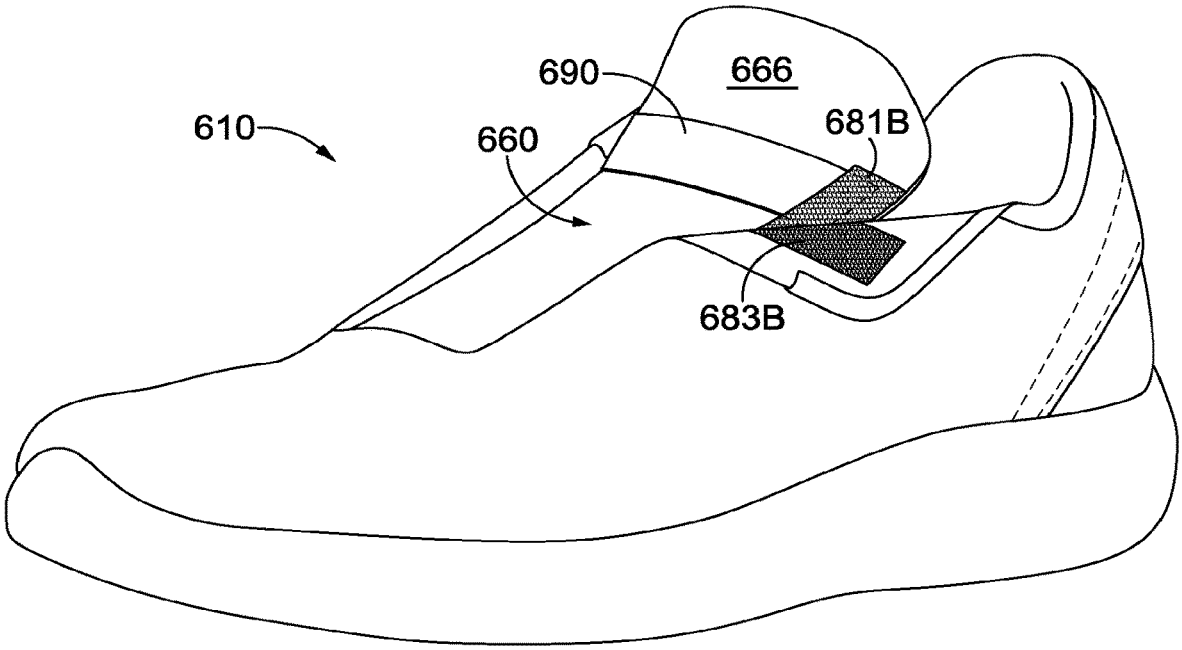
FIGS. 13-16 depict various views of a footwear article having a tongue reinforcer on an outward-facing surface of a tongue in accordance with an aspect of this disclosure.
Figure 14:
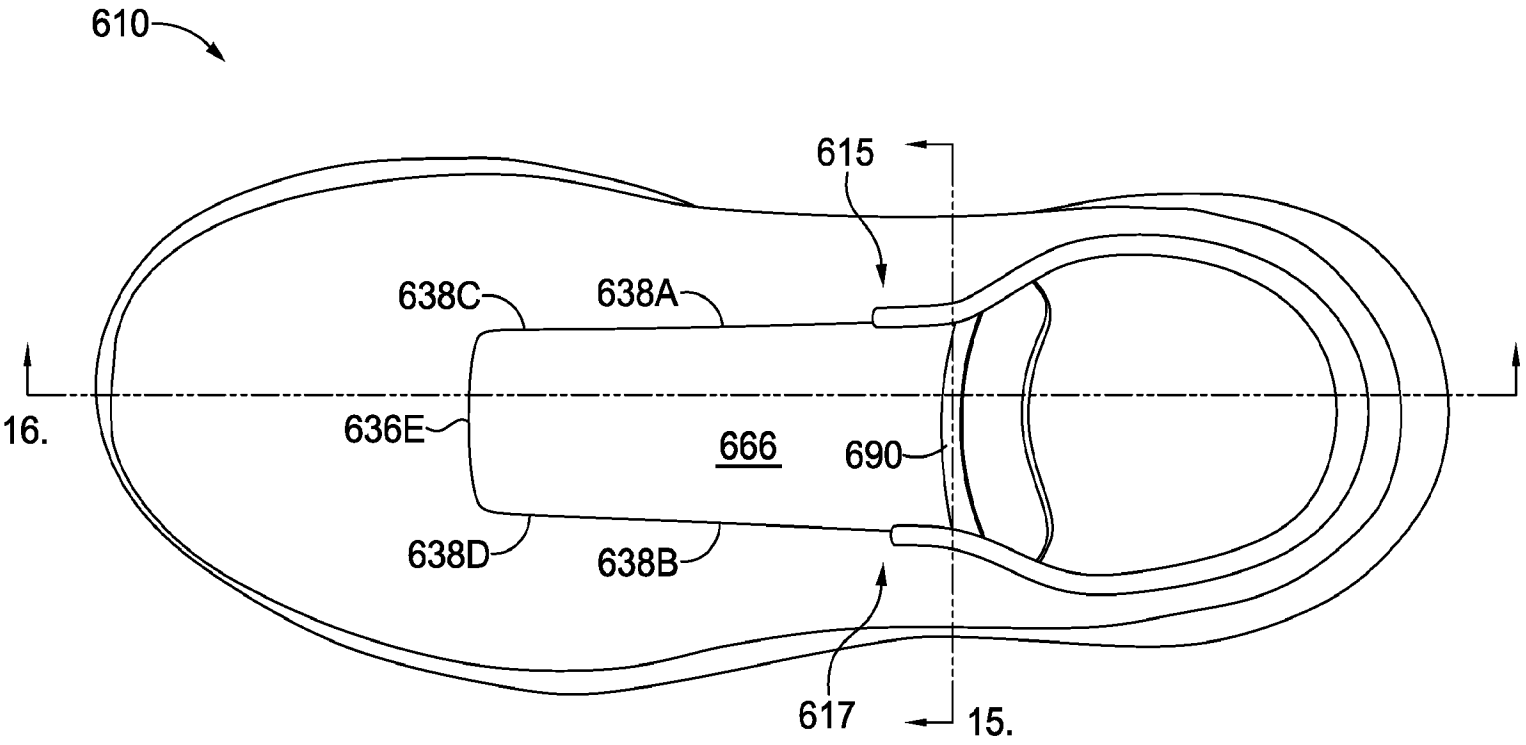
Figure 15:
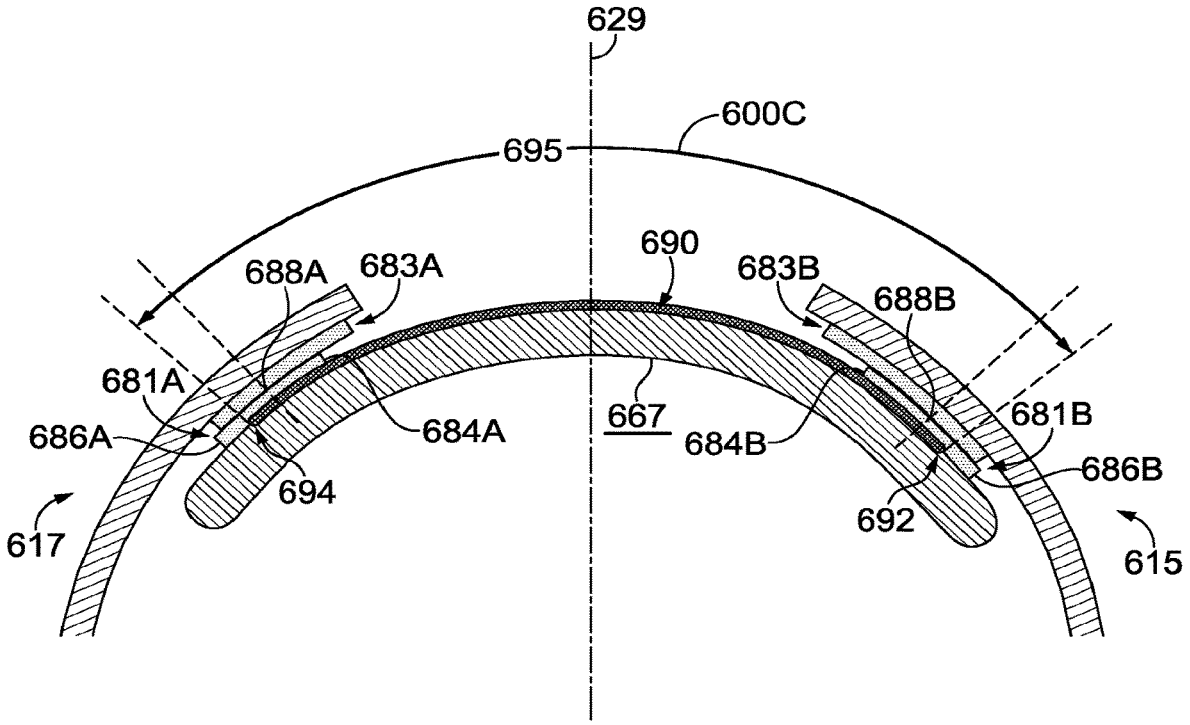

In one aspect, referring to FIG. 10C, the connectors 580 and 582 might be a releasable fastener and includes a tongue-side connector 581A and 581B that releasably mates with a quarter-side connector 583A and 583B. For example, FIG. 12 illustrates an example footwear article in which the releasable fastener is a hook-and-loop connector, such that the tongue-side connector 581A/B is either the hook portion or the loop portion and the quarter-side connector 583A/B is the other of the hook portion or the loop portion. Among other things, a releasable and adjustable fastener may allow a user to adjust and customize a fit of a footwear article by adjusting the connection position of the releasable fastener. A hook-and-loop connector is one type of releasable fastener, and the connector may include other know releasable and adjustable fasteners. Alternatively, non-releasable fasteners 580 and 582 may couple the tongue to the medial and lateral quarters. For example, stitching, welding, bonding, or other types of connectors might connect the quarters to the tongue. In a further example, the lateral-side connector 580 might be one type of connector and the medial-side connector 582 might be a different kind of connector. For example, the lateral-side connector 580 might include a releasable connector, and the medial-side connector 582 might be a non-releasable connector, or vice versa. The lateral-side connector 580 might be a stitch, and the medial-side connector 582 might be hook-and-loop, or vice versa. The lateral-side connector 580 might include integral formation (e.g., knitting) with the quarter, and the medial-side connector 582 might be a releasable fastener (e.g., hook-and-loop). In still another aspect, at least one of the medial-side connector and the lateral-side connector might be omitted, such that at least one of the sides of the tongue is decoupled from the respective quarter.

Referring back to FIG. 10C, the tongue-side connector 581A includes an innermost connector edge 584A positioned closest to the midline reference plane 529 and an outermost connector edge 586 positioned farthest from the midline reference plane. In one aspect, when the quarter-side connector 583A is coupled to the tongue-side connector 581A, at least a portion of the shear force is transferred to the innermost connector edge 584A before eventually being transferred to the tongue 560. Other portions of the shear force may be transferred to other regions of the tongue-side connector 581A between the innermost connector edge 584A and the outermost connector edge 586 before being transferred to the tongue 560. The connectors 581B and 583B operate in a similar manner. That is, when the quarter-side connector 583B is coupled to the tongue-side connector 581B, at least a portion of the shear force is transferred to the innermost connector edge 584B before eventually being transferred to the tongue 560. Other portions of the shear force may be transferred to other regions of the tongue-side connector 581B between the innermost connector edge 584B and the outermost connector edge 586B before being transferred to the tongue 560.

In one aspect of the present disclosure, the footwear article 510 includes a tongue reinforcer 590 extending laterally across the tongue 560. For example, FIG. 6 depicts a portion of the layer 576 cutaway to reveal the tongue reinforcer 590 layered between the outer layer 576 and the inner layer 578. In general, the tongue reinforcer 590 includes an additional material portion that is combined with the one or more tongue material layers. In one aspect, the tongue reinforcer 590 is fixedly attached to the inward-facing surface 567. For example, the tongue reinforcer 590 may be adhered, bonded, or welded to the inward-facing surface. In another example, the tongue reinforcer 590 may be stitched to the inward-facing surface 567. Among other things, the additional material portion adds at least some rigidity to the tongue 560, which might impede the tongue 560 from collapsing, folding, or otherwise deforming under a force applied to the tongue, such as the shear forces transferred from the quarters and/or throat edges by way of the connectors. The tongue reinforcer 590 might include various materials and structures. In one aspect, the tongue reinforcer is constructed of a material that is stiffer than the outer layer 576 based on one or more testing standards, which might be selected by an ordinary skilled artisan. An example of one testing standard that could be used to compare the stiffness of the tongue-reinforcer material to the outer layer 576 is ASTM D1388, and any other suitable testing methodology could be used. In another aspect, the tongue reinforcer is constructed of a knit panel, woven panel, mesh panel, and the like. Furthermore, the tongue reinforcer might be constructed of a plastic, such as nylon, TPU, or other suitable polymer or composite. The tongue reinforcer might be a natural material, such as leather, or a synthetic textile. In another aspect, the tongue reinforcer might be a bi-stable spring element.

The tongue reinforcer includes a medial edge 592, a lateral edge 594, a top edge 596, and a bottom edge 598. In addition, the tongue reinforcer 590 includes a width extending from the medial edge 592 to the lateral edge 594 and a length extending from the top edge 596 to the bottom edge 598. In an aspect of the present invention, the tongue reinforcer 590 includes a size, a position, or a combination there of that inhibits tongue deformation that might otherwise occur as a result of the shearing forces transferred from the quarters and/or throat edges by way of the connectors. For example, as depicted in FIG. 10C, the medial edge 592 of the tongue reinforcer 590 extends past the innermost edge 584B of the tongue-side connector 581B. Stated differently, the innermost edges 584A and 584 B are spaced apart by a distance. The distance might be a summation of one or more arc lengths (if the tongue is in a curved arrangement) taken along a reference plane (e.g., along reference line 10-10 in FIG. 9). Likewise, the tongue reinforcer 590 includes a width measured from the medial edge 592 to the lateral edge 594 along the same reference plane as the distance between the innermost edges, and the tongue reinforcer width is larger than the distance. If this methodology is used to measure the distance and width, then in one aspect, the width and distance are measured along an arc (e.g., 600A or 600B or 600C) having the same radius, with reference lines passing though a common arc center, as well as the respective endpoints.

Figure 10D:
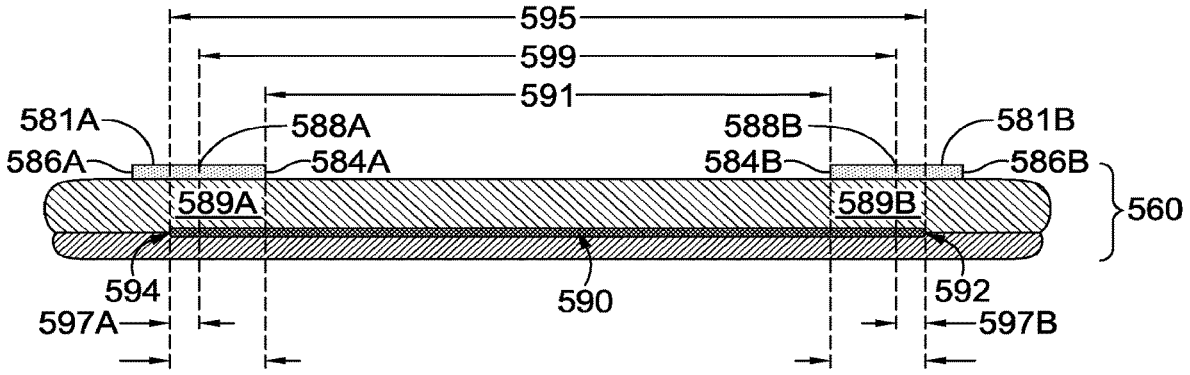

In a similar aspect, and referring to FIG. 10D, which illustrates the tongue 560 in a flat configuration, the tongue reinforcer includes a width 595 between the medial edge 592 and the lateral edge 594. In addition, a distance 591 extends between the innermost edge 584A of the lateral-side connector 581A and the innermost edge 584B of the medial-side connector 581B. The tongue-reinforcer width 595 is larger than the distance 591 extending between the innermost edges of the connectors 581A/B. In another similar aspect, the innermost edge 584A of the lateral-side, tongue-side connector 581A and the lateral edge 594 of the tongue reinforcer 590 overlap with one another (as shown in FIGS. 10C and 10D), and the innermost edge 584B of the medial-side, tongue-side connector 581B and the medial edge 592 of the tongue reinforcer 590 overlap with one another.

The overlap of the tongue-side connectors 581A/B with the tongue reinforcer 590 is created at least in part by the tongue-reinforcer width being larger than the distance between the innermost edges 584A/B. When the tongue-side connectors 581A/B and the tongue reinforcer 590 are fixedly attached to the tongue 560 in this overlap zone 589A and 589B, the tongue 560 provides a medium to transfer the shear forces from the connectors 581A/B to the tongue reinforcer 590. For example, the tongue-side connectors 581A/B may be affixed in the overlap zone to the outward-facing surface 566, and the tongue reinforcer 590 may be fixedly attached within the overlap zone to the inward-facing surface 567. A variety of different couplings might be used. In one aspect, the tongue-side connectors 581A/B and the tongue reinforcer 590 may be bonded, welded, stitched, thermoset, laminated, integrally knit, integrally woven, integrally braided, or any and all combinations thereof to the tongue in the overlap zone 589A/B. In an aspect of the disclosure, the extension of the tongue reinforcer outward and beyond the innermost edges of the connectors 581A/B at least partially inhibits deformation of the tongue that might result from the shearing forces transferred to the innermost edges 584A and 584B.

As described in other aspects, shearing forces might be transferred to various parts of the tongue-side connectors 581A/B, in addition to the innermost edges 584A/B. For example, shear forces might be transmitted to a central portion of the tongue-side connectors 581A/B. In one aspect, the tongue-side connectors 581A/B each include a midpoint 588A (lateral-connector midpoint) and 588B (medial-connector midpoint) positioned between the innermost edge 584A/B and the outermost edge 586A/B. Furthermore, FIG. 10D illustrates a distance 599 between the midpoints 588A/B, and the tongue-reinforcer width 595 is larger than the distance 599. As described above, this overlapping in the region denoted by reference arrows 597A and 597B provides a medium to transfer the shear forces from the connectors 581A/B through the tongue 560 and to the tongue reinforcer 590, when the tongue-side connectors 581A/B and the tongue reinforcer 590 are fixedly attached to the tongue 560 in this portion of the overlap zone 589A/B.

In some aspects of the disclosure, the tongue-reinforcer width (e.g., 595) may be larger than the distance between the innermost edges 584A/B and larger than the distance between the midpoints 588A/B. In other aspects, the tongue-reinforcer width (e.g., 595) may be larger than the distance between the innermost edges 584A/B and shorter than the distance between the midpoints 588A/B. In further aspects, the tongue-reinforcer width (e.g., 595) may be larger than the distance between the innermost edges 584A/B, larger than the distance between the midpoints 588A/B, and larger than a distance between the outermost edges 586A/B. The configuration of the relationship between the width 595 and the other distances (e.g., between outermost edges 586A/B, between midpoints 588A/B, and between innermost edges 584A/B) might be based on various factors, such as the amount of shear force applied by the quarters, the rigidity or flexibility of the tongue, the rigidity or flexibility of the tongue-side connector, the rigidity or flexibility of the tongue reinforcer, or any and all combinations thereof.

In another aspect of the disclosure, a positioning of the tongue reinforcer 590 also contributes to counteracting shearing forces applied from the quarters and to the tongue 560. For example, in some instances the tongue reinforcer 590 is positioned nearer the topline edge 574, as opposed to being positioned more towards the forefoot vamp or the foremost edge 568. This more rearward positioning may be configured based on the location of larger forces applied by the quarters 515 and 517. For example, referring to FIG. 9, various portions of the throat are identified, including 538A, 538B, 538C, 538D, and 538E. The portions 538C and 538D are closer to the throat base 538E, and the portions 538A and 538B are farther from the throat base 538E. As such, the throat base 538E provides a greater resistance to inward motion to the portions 538C and 538D than to the portions 538A and 538B. In addition, the portions 538A and 538B are closer to the forces C, D, E, and F. As such, in general, portions of the tongue 560 that are more heelward or posterior are subject to larger shearing forces from the quarters 515 and 517 than portions that are more forward or anterior.

Figure 11:
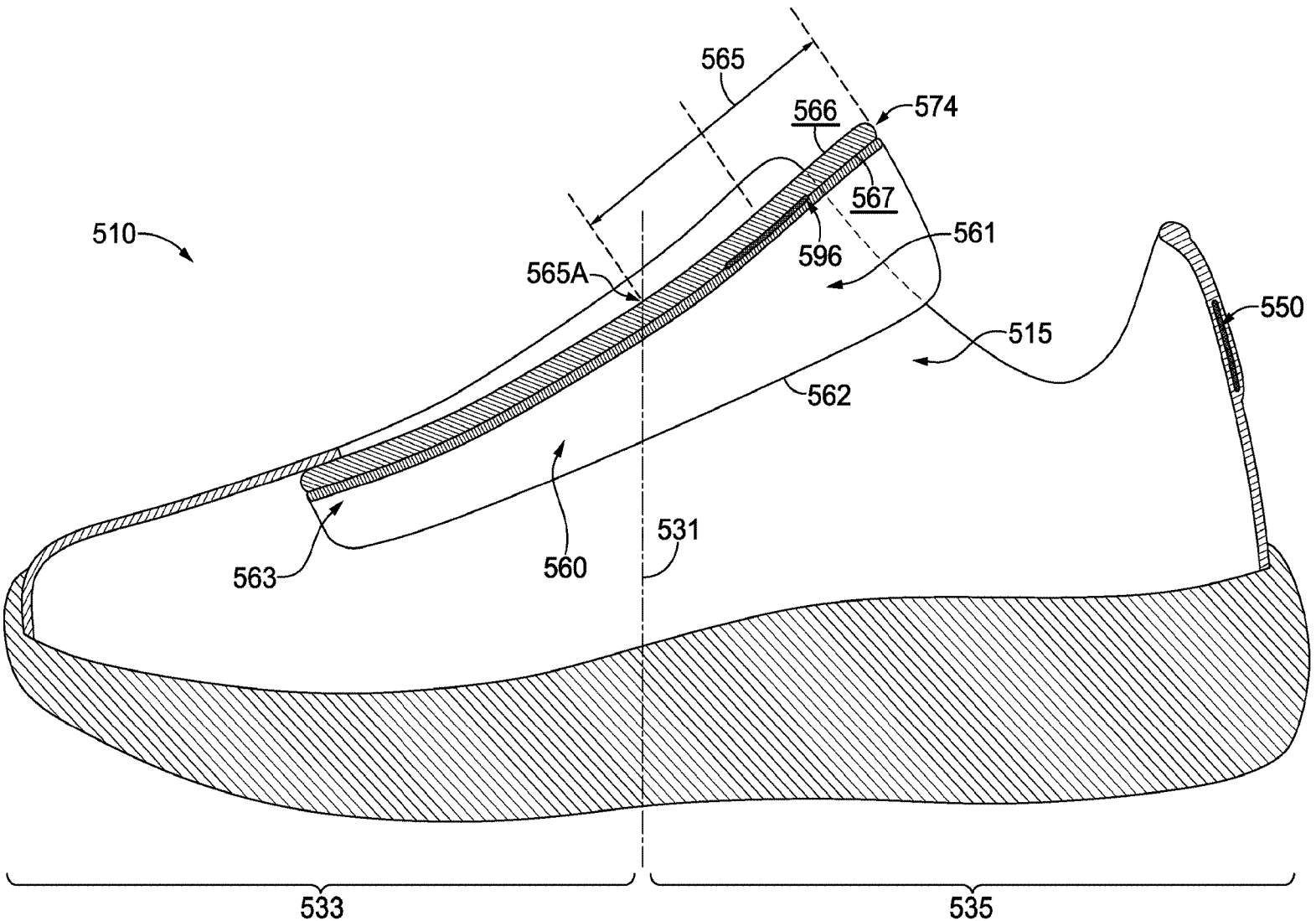
FIG. 11 depicts another cross-sectional view of the footwear article of FIG. 5 in accordance with an aspect of this disclosure.

Referring to FIG. 11, a latitudinal reference plane 531 is depicted that extends in the medial-to-lateral direction perpendicular to the longitudinal reference plane and to a flat ground-surface plane and that is positioned half way between the foremost point of the footwear article 510 and the rearmost point of the footwear article 510. The latitudinal reference plane 531 divides the footwear article 510 into an anterior portion 533 and a posterior portion 535, and divides the tongue 560 into a top tongue portion 561 and a bottom tongue portion 563. The top tongue portion 561 includes a length 565 measured from a tongue reference point 565A (at which the latitudinal reference plane 531 intersects the tongue 560) to the topline edge 574. The length 565 is measured along a line that follows a contour of the outward-facing surface 566. As described with respect to FIGS. 10C and 10D, the tongue reinforcer 590 includes a portion having a width 595, and the width is at least larger than the distance between the innermost edges 584A/B, might be larger than the distance between the midpoints 588A/B, and might be larger than a distance between the outermost edges 586A/B. In accordance with an aspect of this disclosure, the portion having the width 595 is positioned between the tongue reference point 565A (at which the latitudinal reference plane intersects the tongue) and the tongue topline edge 574. In a further aspect, a distance between the portion of the tongue reinforcer having the width and the tongue reference point 565A, is equal to or greater than the length 565. In a further aspect, the portion of the tongue reinforcer is the top edge 596.

As indicated in other portions of this disclosure, the tongue reinforcer 590 include a length extending from the top edge 596 to the bottom edge 598. A dimension of the length may be based on various factors. For example, as described in other portions, the position and width of the tongue reinforcer 590 may be based on the shearing forces closer to the topline edge 574. When sufficient force dissipation is achieved in the top tongue portion 561, a length of the tongue reinforcer may be reduced, in some instance. Among other things, a shorter tongue-reinforcer length may contributed to a lighter-weight footwear article and a more form-fitting tongue. As such, in one aspect of the disclosure, the tongue-reinforcer length is less than the tongue-reinforcer width. In another aspect, the length of the tongue reinforcer is less than the length 565.

Figure 16:
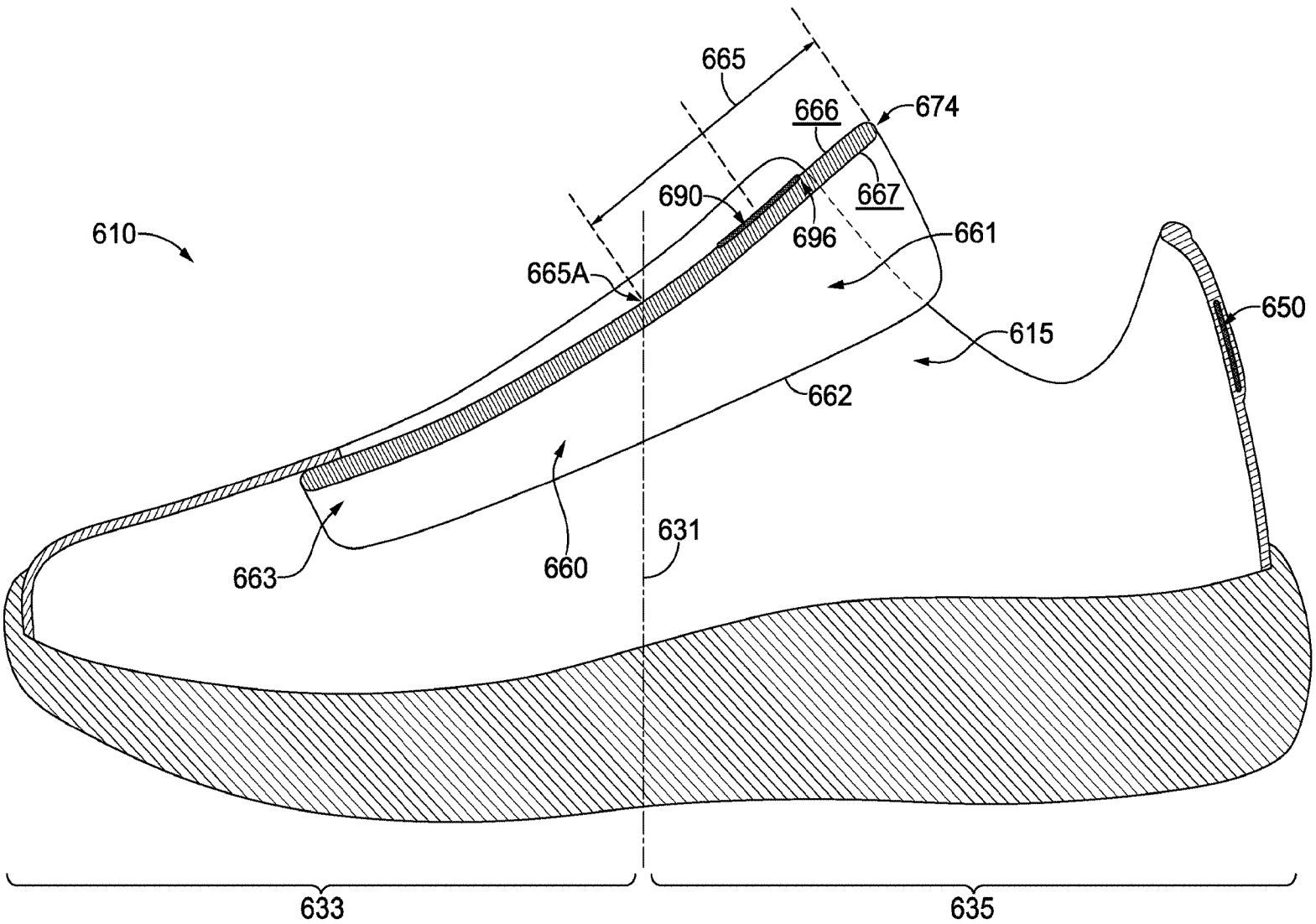

In FIGS. 5-12, the footwear article 510 includes a tongue reinforcer 590 coupled to an inward-facing surface 567 of the tongue. In an alternative aspect, the tongue reinforcer might be coupled to the outward-facing surface of the tongue. For example, referring to FIGS. 13-16, a footwear article 610 includes a tongue reinforcer 690 coupled to an outward-facing surface 666, and below a tongue-side connector 681A. Unless otherwise clearly indicated by the context or explicitly stated, the tongue reinforcer 690 operates in the same manner as the tongue reinforcer 590, and the description with respect to the tongue reinforcer 590 equally applies to the tongue reinforcer 690. For example, similar to the tongue reinforcer 590, the tongue reinforcer 690 includes a medial edge 692 and a lateral edge 694. In accordance with an aspect of this disclosure, the tongue reinforcer 690 includes a portion having a width 695, and the width is at least larger than the distance between the innermost edges 684A/B, might be larger than the distance between the midpoints 688A/B, and might be larger than a distance between the outermost edges 686A/B. Referring to FIG. 16, in a further aspect, the portion having the width 695 (equal to or greater than the distance between the innermost edges 684A/B) is positioned between the tongue reference point 665A (which intersects the latitudinal reference plane 631) and the tongue topline edge 674. In another aspect, a distance between the portion of the tongue reinforcer having the width and the tongue reference point 665A, is equal to or greater than half of the length 665. In a further aspect, the portion of the tongue reinforcer having the width is the top edge 696.

From the foregoing, it will be seen that this invention is one well adapted to attain all the ends and objects hereinabove set forth together with other advantages which would be realized by an ordinary skilled artisan and which are inherent to the structure.

It will be understood that certain features and subcombinations are of utility and may be employed without reference to other features and subcombinations. This is contemplated by and is within the scope of the claims.

Since many possible aspects may be made of the invention without departing from the scope thereof, it is to be understood that all matter herein set forth or shown in the accompanying drawings is to be interpreted as illustrative and not in a limiting sense.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

Clause 1. A footwear article comprising: an upper coupled to a sole, the upper comprising a medial side, a lateral side, a heel region, and an ankle collar movable between a lowered state positioned closer to the sole and a raised state positioned farther from the sole; a tongue; a medial-side connector having a width and a midpoint, the medial side connector attaching the tongue to the medial side; a lateral-side connector having a width and a midpoint, the lateral side connector attaching the tongue to the lateral side and spaced apart from the medial-side connector by a first length; and a tongue reinforcer coupled to the tongue and having a tongue-reinforcer medial edge and a tongue-reinforcer lateral edge that are spaced apart from one another by a second length, wherein the second length is equal to or greater than the first length.

Clause 2. The footwear article of any of the clauses, wherein the tongue includes a first material layer having a first stiffness; and wherein the tongue reinforcer includes a second material layer having a second stiffness equal to or greater than the first stiffness.

Clause 3. The footwear article of any of the clauses, wherein the tongue includes a first material layer having an outward-facing surface and an inward-facing surface, and wherein the inward-facing surface is between the tongue reinforcer and the outward-facing surface.

Clause 4. The footwear article of any of the clauses, wherein the tongue reinforcer is coupled to the inward-facing surface of the first material layer of the tongue.

Clause 5. The footwear article of any of the clauses, wherein the tongue includes a first material layer having an outward-facing surface and an inward-facing surface, and wherein the outward-facing surface is between the tongue reinforcer and the inward-facing surface.

Clause 6. The footwear article of any of the clauses, wherein the medial-side connector includes a first part of a first hook-and-loop connector, wherein a second part of the first hook-and-loop connector is attached to the medial side, wherein the lateral-side connector includes a first part of a second hook-and-loop connector, and wherein a second part of the second hook-and-loop connector is attached to the lateral side.

Clause 7. The footwear article of any of the clauses, wherein the tongue includes a tongue reference point that intersects a latitudinal midline reference plane of the footwear article, and wherein a portion of the tongue reinforcer is positioned between the tongue reference point and a topline edge of the tongue.

Clause 8. The footwear article of any of the clauses, wherein the entirety of the tongue reinforcer is positioned between the tongue reference point and a topline of the tongue.

Clause 9. The footwear article of any of the clauses, wherein the tongue includes a tongue interior layer and a tongue exterior layer, and wherein the tongue reinforcer is located between the tongue interior layer and the tongue exterior layer.

Clause 10. A footwear article comprising: an upper coupled to a sole, the upper comprising a forefoot region, a medial side, a lateral side, a heel region, and an ankle collar; a tongue having a topline edge nearer to the heel region than the forefoot region, and a tongue reference point intersecting a latitudinal midline reference plane of the footwear article; at least one connector attaching the tongue to either the medial side or the lateral side; and a tongue reinforcer coupled to the tongue and having at least a portion that overlaps with the at least one connector, wherein the portion is positioned between the tongue reference point and the topline edge.

Clause 11. The footwear article of any of the clauses, wherein a first distance between the tongue reference point and the portion is equal to or larger than half of a second distance extending from the tongue reference point to the topline edge.

Clause 12. The footwear article of any of the clauses, wherein the connector includes a first part of a hook-and-loop connector, and wherein a second part of the hook-and-loop connector is attached to the medial side or the lateral side.

Clause 13. The footwear article of any of the clauses, wherein the tongue includes a first material layer having an outward-facing surface and an inward-facing surface, and wherein the inward-facing surface is between the tongue reinforcer and the outward-facing surface.

Clause 14. The footwear article of any of the clauses, wherein the tongue includes a first material layer having an outward-facing surface and an inward-facing surface, and wherein the outward-facing surface is between the tongue reinforcer and the inward-facing surface.

Clause 15. A footwear article comprising: an upper coupled to a sole, the upper comprising a medial side, a lateral side, a heel region, and an ankle collar movable between a lowered state positioned closer to the sole and a raised state positioned farther from the sole; a tongue having a topline edge and a tongue reference point intersecting a latitudinal midline reference plane of the footwear article; at least one connector attaching the tongue to either the medial side or the lateral side; and a tongue reinforcer coupled to the tongue and having a tongue-reinforcer width extending from a tongue-reinforcer medial edge to a tongue-reinforcer lateral edge and having a tongue-reinforcer length extending from a tongue-reinforcer top edge to a tongue-reinforcer bottom edge, wherein the tongue-reinforcer width is larger than the tongue-reinforcer length, and wherein the tongue-reinforcer top edge is between the tongue reference point and the topline edge.

Clause 16. The footwear article of any of the clauses, wherein the tongue-reinforcer bottom edge is positioned between the tongue reference point and the topline edge.

Clause 17. The footwear article of any of the clauses, wherein the tongue reinforcer includes a portion that overlaps with the at least one connector and wherein the portion is between the tongue reference point and the topline edge.

The invention claimed is:

1. A footwear article comprising:

an upper coupled to a sole, the upper comprising a medial side, a lateral side, a heel region, and an ankle collar movable between a lowered state positioned closer to the sole and a raised state positioned farther from the sole;

a tongue;

a medial-side connector having a width and a midpoint, the medial side connector attaching the tongue to the medial side;

a lateral-side connector having a width and a midpoint, the lateral side connector attaching the tongue to the lateral side and spaced apart from the medial-side connector by a first length; and a tongue reinforcer coupled to the tongue and having a tongue-reinforcer medial edge and a tongue-reinforcer lateral edge that are spaced apart from one another by a second length, wherein the second length is equal to or greater than the first length.

2. The footwear article of claim 1, wherein the tongue includes a first material layer having a first stiffness; and wherein the tongue reinforcer includes a second material layer having a second stiffness equal to or greater than the first stiffness.

3. The footwear article of claim 1, wherein the tongue includes a first material layer having an outward-facing surface and an inward-facing surface, and wherein the inward-facing surface is between the tongue reinforcer and the outward-facing surface.

4. The footwear article of claim 3, wherein the tongue reinforcer is coupled to the inward-facing surface of the first material layer of the tongue.

5. The footwear article of claim 1, wherein the tongue includes a first material layer having an outward-facing surface and an inward-facing surface, and wherein the outward-facing surface is between the tongue reinforcer and the inward-facing surface.

6. The footwear article of claim 1, wherein the medial-side connector includes a first part of a first hook-and-loop connector, wherein a second part of the first hook-and-loop connector is attached to the medial side, wherein the lateral-side connector includes a first part of a second hook-and-loop connector, and wherein a second part of the second hook-and-loop connector is attached to the lateral side.

7. The footwear article of claim 1, wherein the tongue includes a tongue reference point that intersects a latitudinal midline reference plane of the footwear article, and wherein a portion of the tongue reinforcer is positioned between the tongue reference point and a topline edge of the tongue.

8. The footwear article of claim 7, wherein the entirety of the tongue reinforcer is positioned between the tongue reference point and a topline of the tongue.

9. The footwear article of claim 1, wherein the tongue includes a tongue interior layer and a tongue exterior layer, and wherein the tongue reinforcer is located between the tongue interior layer and the tongue exterior layer.

10. A footwear article comprising:

an upper coupled to a sole, the upper comprising a forefoot region, a medial side, a lateral side, a heel region, and an ankle collar;

a tongue having a topline edge nearer to the heel region than the forefoot region, and a tongue reference point intersecting a latitudinal midline reference plane of the footwear article;

at least one connector attaching the tongue to either the medial side or the lateral side; and a tongue reinforcer coupled to the tongue and having at least a portion that overlaps with the at least one connector, wherein the portion is positioned between the tongue reference point and the topline edge.

11. The footwear article of claim 10, wherein a first distance between the tongue reference point and the portion is equal to or larger than half of a second distance extending from the tongue reference point to the topline edge.

12. The footwear article of claim 10, wherein the connector includes a first part of a hook-and-loop connector, and wherein a second part of the hook-and-loop connector is attached to the medial side or the lateral side.

13. The footwear article of claim 10, wherein the tongue includes a first material layer having an outward-facing surface and an inward-facing surface, and wherein the inward-facing surface is between the tongue reinforcer and the outward-facing surface.

14. The footwear article of claim 10, wherein the tongue includes a first material layer having an outward-facing surface and an inward-facing surface, and wherein the outward-facing surface is between the tongue reinforcer and the inward-facing surface.

15. A footwear article comprising:

an upper coupled to a sole, the upper comprising a medial side, a lateral side, a heel region, and an ankle collar movable between a lowered state positioned closer to the sole and a raised state positioned farther from the sole;

a tongue having a topline edge and a tongue reference point intersecting a latitudinal midline reference plane of the footwear article;

at least one connector attaching the tongue to either the medial side or the lateral side; and a tongue reinforcer coupled to the tongue and having a tongue-reinforcer width extending from a tongue-reinforcer medial edge to a tongue-reinforcer lateral edge and having a tongue-reinforcer length extending from a tongue-reinforcer top edge to a tongue-reinforcer bottom edge, wherein the tongue-reinforcer width is larger than the tongue-reinforcer length, and wherein the tongue-reinforcer top edge is between the tongue reference point and the topline edge.

16. The footwear article of claim 15, wherein the tongue-reinforcer bottom edge is positioned between the tongue reference point and the topline edge.

17. The footwear article of claim 15, wherein the tongue reinforcer includes a portion that overlaps with the at least one connector and wherein the portion is between the tongue reference point and the topline edge.

* * * * *